US011265651B2

(12) United States Patent
Hashimoto et al.

(10) Patent No.: US 11,265,651 B2
(45) Date of Patent: Mar. 1, 2022

(54) VIBRATION OUTPUT APPARATUS AND COMPUTER-READABLE, NON-TRANSITORY STORAGE MEDIUM STORING VIBRATION OUTPUT PROGRAM

(71) Applicant: CLARION CO., LTD., Saitama (JP)

(72) Inventors: Takeshi Hashimoto, Motomiya (JP); Yasuhiro Fujita, Kashiwa (JP)

(73) Assignee: CLARION CO., LTD., Saitama (JP)

( * ) Notice: Subject to any disclaimer, the term of this patent is extended or adjusted under 35 U.S.C. 154(b) by 91 days.

(21) Appl. No.: 16/892,285

(22) Filed: Jun. 4, 2020

(65) Prior Publication Data

US 2020/0389730 A1 Dec. 10, 2020

(30) Foreign Application Priority Data

Jun. 5, 2019 (JP) ..... JP2019-105257

(51) Int. Cl.
*H04R 3/04* (2006.01)

(52) U.S. Cl.
CPC ..... *H04R 3/04* (2013.01); *H04R 2400/03* (2013.01); *H04R 2430/01* (2013.01)

(58) Field of Classification Search
CPC .. H04R 3/04; H04R 2400/03; H04R 2430/01; H04R 3/14; H04R 2430/03
USPC ..... 381/98–99, 103, 62
See application file for complete search history.

(56) References Cited

U.S. PATENT DOCUMENTS

| | | | | |
|---|---|---|---|---|
| 11,039,234 | B2 * | 6/2021 | Linjama | A63F 13/285 |
| 2007/0237342 | A1 * | 10/2007 | Agranat | H04R 1/406 381/97 |
| 2019/0342662 | A1 | 11/2019 | Fukue et al. | |

FOREIGN PATENT DOCUMENTS

| | | |
|---|---|---|
| EP | 3244628 | 11/2017 |
| EP | 3310071 | 4/2018 |
| JP | 2007-065038 | 3/2007 |
| JP | 2008-072165 | 3/2008 |
| WO | WO 2017/031500 | 2/2017 |

OTHER PUBLICATIONS

Extended European Search Report for corresponding EP Application No. 20178115.0-1207, dated Sep. 7, 2020.

* cited by examiner

*Primary Examiner* — Disler Paul
(74) *Attorney, Agent, or Firm* — Mori & Ward, LLP

(57) ABSTRACT

A frequency compressor of a vibration output apparatus generates a compressed signal by converting frequency components of a mid-band signal into low-band frequency components of a low-band signal by increasing the total number of samples by a factor of n and thus compressing the frequency of amplitude information included in mid-band frequency components of the mid-band signal to 1/n. If the level of a low-band envelope signal is lower than a predetermined threshold level, a vibration signal generator generates a vibration signal by combining the compressed signal with the low-band signal consisting of the low-band frequency components of an acoustic signal. If the level of the low-band envelope signal is higher than the predetermined threshold level, the vibration signal generator generates a vibration signal by directly using the low-band signal. A vibration output unit outputs a vibration on the basis of the generated vibration signal.

12 Claims, 23 Drawing Sheets

TABLE 2 LEVEL CORRECTION PARAMETERS

| ITEMS | SETTING VALUES |
|---|---|
| MAXIMUM VALUE DETECTION | 128 sample |
| CONTROL MINIMUM VALUE | −40 dB |
| ATTACK TIME | 0.5 sec |
| HOLD TIME | 0.5 sec |
| RELEASE TIME | 10 sec |

FIG. 21A

TABLE 3 FREQUENCY COMPRESSION PARAMETERS

| ITEMS | SETTING VALUES |
|---|---|
| COMPRESSION RATIO | 0.5 |
| SAMPLE EXTRACTION | 112 sample |
| WEIGHT A | HANNING WINDOW 96 sample |
| WEIGHT B | HANNING WINDOW 96 sample |

FIG. 21B

TABLE 4 FREQUENCY COMPRESSION PARAMETERS USED BY FREQUENCY COMPRESSOR

| | | |
|---|---|---|
| 100 Hz - 200 Hz:1/2 | ⇒ | 50 Hz - 100 Hz |
| 100 Hz - 300 Hz:1/3 | ⇒ | 33 Hz - 100 Hz |
| 100 Hz - 400 Hz:1/4 | ⇒ | 25 Hz - 100 Hz |

*FIG. 22A*

TABLE 1 CONDITIONS, FREQUENCY RANGE AND DYNAMIC RANGES OF AUDITORY SENSE AND TACTILE SENSE

| | CONDITIONS | FREQUENCY RANGE AND DYNAMIC RANGES |
|---|---|---|
| AUDITORY SENSE | MINIMUM AUDIBLE THRESHOLD LEVEL:0 dB SPL<br>MAXIMUM AUDIBLE LEVEL:120 dB SPL | FREQUENCY RANGE:20 Hz - 20,000 Hz<br>LEVEL:120dB |
| TACTILE SENSE | MEISSNER'S CORPUSCLE<br>MINIMUM THRESHOLD:10 μm<br>MAXIMUM AMPLITUDE:1 mm | FREQUENCY RANGE:10 Hz - 150 Hz<br>LEVEL:40dB |

*RELATED ART*

*FIG. 22B*

VIBRATION OUTPUT APPARATUS AND COMPUTER-READABLE, NON-TRANSITORY STORAGE MEDIUM STORING VIBRATION OUTPUT PROGRAM

CROSS-REFERENCE TO RELATED APPLICATIONS

The present application claims priority to Japanese Patent Application JP 2019-105257 filed in the Japan Patent Office on Jun. 5, 2019, the entire content of which is hereby incorporated by reference.

BACKGROUND OF THE INVENTION

Field of the Invention

The present invention relates to a vibration output apparatus and a computer-readable, non-transitory storage medium storing a vibration output program.

Description of the Related Art

There have been proposed methods of making a predetermined notification or providing a realistic sound environment by causing the user to perceive a vibration generated by a vibration generator. For example, Japanese Unexamined Patent Application Publication Nos. 2007-65038 and 2008-72165 disclose seat audio systems in which a full-range speaker is installed near the headrest of the seat and a subwoofer is installed in the backrest or seating portion of the seat.

A full-range speaker is able to output a sound in a low-to-high wide band on the basis of an input signal, and the sound outputted from the full-range speaker is able to stimulate the auditory sense of the user. A subwoofer is able to output one or both of a low-band sound and a vibration on the basis of an input signal, and the sound and/or vibration outputted from the subwoofer are able to stimulate the auditory sense and/or the tactile sense of the user.

Examples of a speaker installed in the seat include dynamic speakers using cone paper or the like and linear resonant actuators, such as exciters, which vibrate the contact surface. If a linear resonant actuator is used as a speaker, the single output means is able to output both a sound and a vibration.

Humans perceive a sound through the auditory sense and perceive a vibration through the tactile sense. The dynamic range of the tactile sense of humans differs from that of the auditory sense. FIG. 22B represents Table 1 showing the conditions and the frequency range and dynamic ranges under which humans are able to perceive a sound through the auditory sense and the conditions and the frequency range and dynamic ranges under which humans are able to perceive a vibration through the tactile sense.

As shown in Table 1 of FIG. 22B, the sound pressure level (SPL) (audible level) of sounds that humans are able to hear through the auditory sense is 0 to 120 dB. When a human perceives a vibration through the tactile sense, the Meissner's corpuscle, which is a type of mechanoreceptor present in the skin or the like, detects the vibration. The amount of displacement detectable by the Meissner's corpuscle is 10 μm to 1 mm. That is, the sound level perceivable by humans and the vibration level perceivable by humans are based on quite different criteria.

Also, even if a sound or vibration satisfies the above conditions, whether a human is able to perceive the sound or vibration depends on the frequency range and the dynamic range (the level difference or relative level difference) of the sound or vibration.

The frequency range of sounds that humans are able to perceive through the auditory sense is about 20 to 20,000 Hz, and humans are not able to auditorily perceive sounds having a frequency exceeding this frequency range. Also, the dynamic range (level difference) of the difference between sounds that humans are able to perceive is about 120 dB. On the other hand, the frequency range of vibrations that humans are able to perceive through the tactile sense is about 10 to 150 Hz, and the dynamic range (level difference) of the difference between vibrations that humans are able to perceive is about 40 dB.

There are large differences between the frequency range and dynamic range (level difference) of sounds that humans are able to perceive through the auditory sense and those of vibrations that humans are able to perceive through the tactile sense.

The frequency and level of an acoustic signal outputted from a sound source in order to output a sound from a speaker is set in a frequency range and level difference corresponding to the dynamic range of the auditory sense. The dynamic range (level difference) of vibrations that humans are able to perceive through the tactile sense is narrower than that of sounds that humans are able to perceive through the auditory sense. For this reason, if a full-range speaker and a subwoofer output a sound and a vibration, respectively, on the basis of the same acoustic signal, the perceptibility of the vibration through the tactile sense of the user would be lower than the perceptibility of the sound through the auditory sense of the user. That is, when a vibration is generated on the basis of an acoustic signal, the perception level at which the user perceives the acoustic signal as a vibration may be lower than the perception level at which the user perceives the acoustic signal as a sound.

The frequency range of vibrations that humans are able to perceive through the tactile sense is lower than that of sounds that humans are able to perceive through the auditory sense. For this reason, even when a vibration is generated on the basis of an acoustic signal, if the acoustic signal does not include a large amount of frequency components that the allows the user to perceive the vibration through the tactile sense, the user would be able to perceive a sound through the auditory sense but have difficulty in perceiving a vibration through the tactile sense.

Theater systems or game systems are currently being provided that provide a realistic appreciation environment by outputting the images of movies, games, or the like such that sounds and vibrations are emphasized. In theater systems or game systems, sounds and vibrations are often generated on the basis of the music or sound effects of movies or games. However, whether the user is able to effectively perceive sounds and vibrations such that the sounds and vibrations are combined together depends on the frequency range and dynamic range (level difference) of the acoustic signals, that is, depends on the acoustic characteristics of the acoustic signals.

An object of the present invention is to provide a vibration output apparatus and a computer-readable, non-transitory storage medium storing a vibration output program that are able to cause the user to effectively perceive vibrations.

SUMMARY OF THE INVENTION

A vibration output apparatus according to one aspect of the present invention includes a low-band signal generator configured to generate a low-band signal by extracting low-band frequency components from an acoustic signal, a mid-band signal generator configured to generate a mid-band signal by extracting mid-band frequency components from the acoustic signal, the mid-band signal including samples arranged in a time-series manner and each having amplitude information, a frequency compressor configured to generate a compressed signal by converting frequency components of the mid-band signal into the low-band frequency components of the low-band signal by increasing the total number of samples by a factor of n and thus compressing a frequency of the amplitude information included in the mid-band frequency components of the mid-band signal to 1/n by interpolating amplitude information for interpolation between the adjacent samples having the amplitude information, a low-band envelope signal calculator configured to calculate a low-band envelope signal by performing an integration process on the low-band signal, a vibration signal generator configured to, when a level of the low-band envelope signal is lower than a predetermined threshold level, generate a vibration signal by combining the compressed signal with the low-band signal and to, when the level of the low-band envelope signal is higher than the predetermined threshold level, generate the vibration signal by directly using the low-band signal, and a vibration output unit configured to output a vibration on the basis of the vibration signal generated by the vibration signal generator.

A computer-readable, non-transitory storage medium storing a vibration output program according to another aspect of the present invention is a computer-readable, non-transitory storage medium storing a vibration output program executed by a vibration output apparatus configured to output a vibration from a vibration output unit on the basis of a vibration signal. The vibration output program causes a controller to perform a low-band signal generation process of generating a low-band signal by extracting low-band frequency components from an acoustic signal, a mid-band signal generation process of generating a mid-band signal by extracting mid-band frequency components from the acoustic signal, the mid-band signal including samples arranged in a time-series manner and each having amplitude information, a frequency compression process of generating a compressed signal by converting frequency components of the mid-band signal into the low-band frequency components of the low-band signal by increasing the total number of samples by a factor of n and thus compressing a frequency of the amplitude information included in the mid-band frequency components of the mid-band signal to 1/n by interpolating amplitude information for interpolation between the adjacent samples having the amplitude information, a low-band envelope signal calculation process of calculating a low-band envelope signal by performing an integration process on the low-band signal, a vibration signal generation process of, when a level of the low-band envelope signal is lower than a predetermined threshold level, generating the vibration signal by combining the compressed signal with the low-band signal and, when the level of the low-band envelope signal is higher than the predetermined threshold level, generating the vibration signal by directly using the low-band signal, and a vibration output process of outputting the vibration from the vibration output unit on the basis of the vibration signal generated in the vibration signal generation process.

The term "predetermined threshold level" refers to the minimum level of the low-band envelope signal that when the vibration signal is generated by directly using the low-band signal without combining the compressed signal with the low-band signal and a vibration is outputted from the vibration output unit, allows the user to perceive the vibration as a sufficient magnitude of vibration.

The vibration output apparatus and computer-readable, non-transitory storage medium storing a vibration output program according to an embodiment of the present invention generate the compressed signal by changing the level of the signal consisting of the mid-band frequency components of the acoustic signal to the level of the low-band frequency components of the low-band signal by compressing the frequency and combines the compressed signal with the low-band signal. Thus, the vibration output apparatus and vibration output program are able to reinforce changes in the level of the mid-band frequency components of the acoustic signal as changes in the level of the low-band frequency components that the user is able to perceive as a vibration. Consequently, the vibration output apparatus and vibration output program are able to generate a vibration with strength that the user is able to sufficiently perceive and to cause the user to perceive the vibration with higher perceptibility.

The vibration output apparatus and computer-readable, non-transitory storage medium storing a vibration output program according to the embodiment of the present invention reinforce the signal level of the low-band frequency components by combining the compressed signal with the low-band signal when the level of the low-band signal is lower than the level of the acoustic signal. Thus, the vibration output apparatus and computer-readable, non-transitory storage medium storing a vibration output program are able to properly control the balance between the perceptibility of the sound through the auditory sense of the user and the perceptibility of the vibration through the tactile sense of the user. As a result, the vibration output apparatus and computer-readable, non-transitory storage medium storing a vibration output program are able to increase the togetherness of the sound and vibration and to output the sound and vibration without causing a feeling of strangeness.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

FIG. 21A shows a Table 2 showing the parameters of a process performed by the functional elements of a first level corrector according to the present embodiment;

FIG. 21B shows a Table 3 showing the parameters of a process performed by the functional elements of the frequency compressor according to the present embodiment;

FIG. 22A shows a Table 4 showing frequency compression parameters used by the frequency compressor according to the present embodiment;

FIG. 22B represents a Table 1 showing the conditions and the frequency range and dynamic ranges under which humans are able to perceive a sound through the auditory sense and the conditions and the frequency range and dynamic ranges under which humans are able to perceive a vibration through the tactile sense.

DESCRIPTION OF THE EMBODIMENTS

Figure 1:
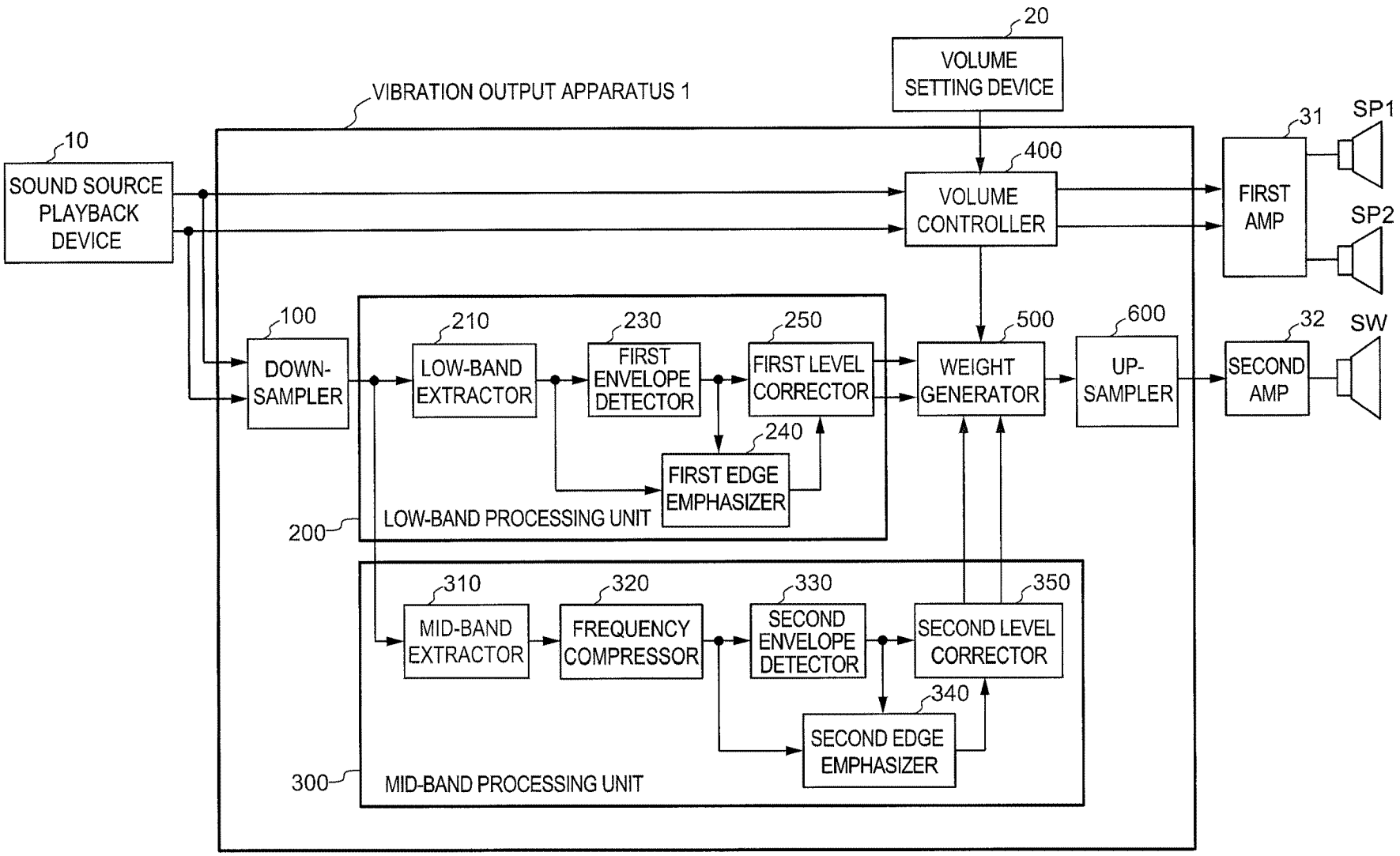
FIG. 1 is a block diagram showing a schematic configuration of the functional elements of a vibration output apparatus according to an embodiment of the present invention.
Figure 23:
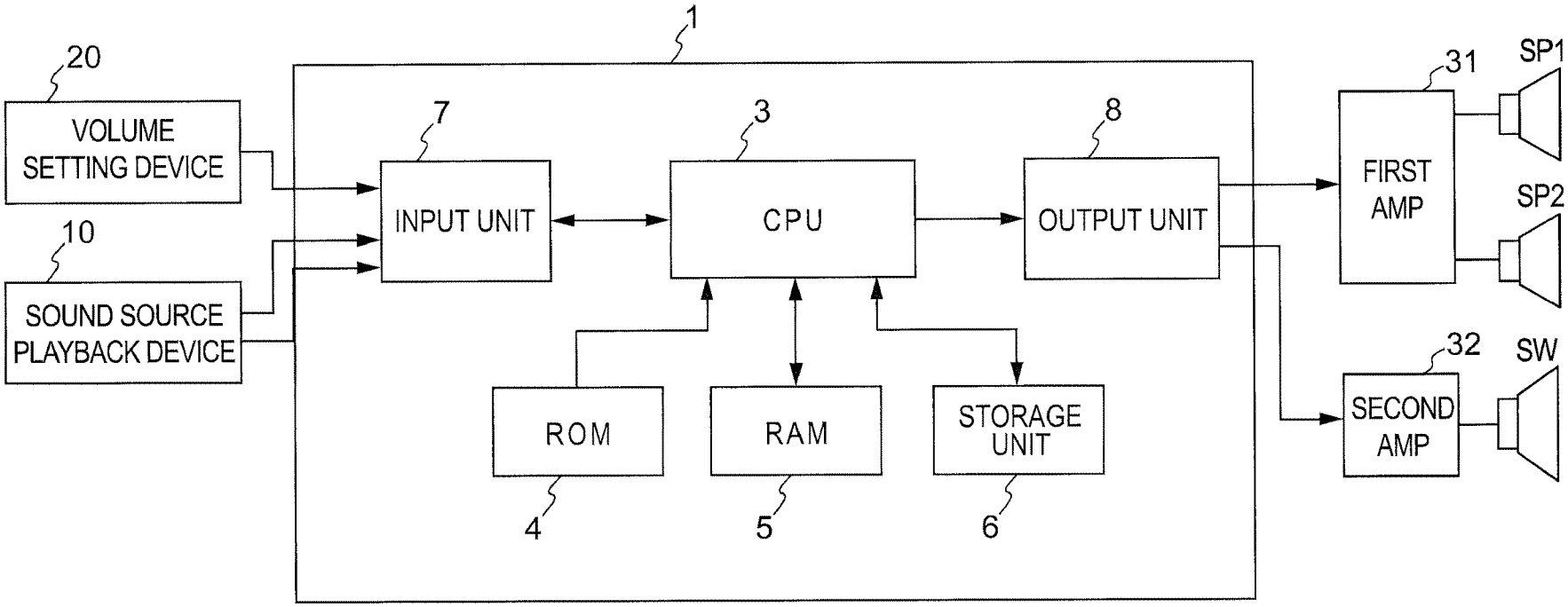
FIG. 23 is a block diagram showing a schematic configuration of hardware of the vibration output apparatus according to the present embodiment.

Now, a vibration output apparatus according to an embodiment of the present invention will be described in detail with reference to the drawings. FIG. 1 is a block diagram showing an example of the functional elements of the vibration output apparatus. FIG. 23 is a block diagram showing an example of the hardware configuration of the vibration output apparatus.

[Vibration Output Apparatus]

As shown in FIG. 1, a vibration output apparatus 1 includes a downsampler 100, a low-band processing unit 200, a mid-band processing unit 300, a volume controller (vibration level determination unit) 400, a weight generator (vibration signal generator) 500, and an upsampler 600. The downsampler 100, low-band processing unit 200, mid-band processing unit 300, volume controller 400, weight generator 500, and upsampler 600 shown in FIG. 1 represent the functional elements implemented when the CPU 3 of the vibration output apparatus 1 shown in FIG. 23 performs a predetermined process in accordance with software.

Specifically, as shown in FIG. 23, the vibration output apparatus 1 includes the CPU (central processing unit; controller) 3, a ROM (read only memory; non-transitory storage medium) 4, a RAM (random access memory) 5, a storage unit (non-transitory storage medium) 6, an input unit 7, and an output unit 8. The ROM 4 stores a programs describing processes performed by the CPU 3 in the vibration output apparatus 1. The RAM is used as a work area when the CPU 3 performs a process. The storage unit consists of, for example, a hard disk drive (HDD), a solid state drive (SSD), or the like and stores data or the like required for processes. Note that the programs executed by the CPU 3 when performing the processes may be stored in the storage unit rather than in the ROM 4. When the CPU 3 performs a process on the basis of a program stored in the ROM 4, the above functional elements perform respective processes.

As shown in FIGS. 1 and 23, a sound source playback device 10 and a volume setting device 20 are connected to the vibration output apparatus 1 through the input unit 7, and a first amplifier 31 and a second amplifier 32 are connected to the vibration output apparatus 1 through the output unit 8. The input unit 7 is an interface for inputting an acoustic signal outputted by the sound source playback device 10 to the vibration output apparatus 1. The input unit 7 is, for example, an input terminal according to a standard, such as Universal Serial Bus (USB) or IEEE 1394, a line-in (microphone) terminal, or the like. The output unit 8 is an interface for outputting an acoustic signal outputted by the volume controller 400 of the vibration output apparatus 1 to the first amplifier 31 and outputting a vibration signal outputted by the upsampler 600 to the second amplifier 32. The output unit 8 is, for example, an output terminal according to a standard, such as USB or IEEE 1394, a line-out (earphone) terminal, or the like. Full-range speakers SP1 and SP2 are connected to the first amplifier 31, and a subwoofer (vibration output unit) SW is connected to the second amplifier 32.

[Sound Source Playback Device]

The sound source playback device 10 is a device that outputs acoustic signals to the vibration output apparatus 1. The sound source playback device 10 is, for example, a CD player, DVD player, or the like that outputs acoustic signals (input signals) indicating images or sounds stored in a CD, DVD, or the like to the vibration output apparatus 1.

The sound source playback device 10 outputs acoustic signals to the downsampler 100 and volume controller 400. Note that the sound source playback device 10 outputs two types of acoustic signals: a right-channel acoustic signal and a left-channel acoustic signal. The acoustic signals for respective channels are inputted to the full-range speakers SP1 and SP2 and subwoofer SW, which then separately output sounds or vibration.

[Volume Setting Device]

The volume setting device 20 is a device that controls the volume level of the acoustic signals outputted by the sound source playback device 10. The volume setting unit 20 is, for example, a typical volume setting control mechanism or the like. By setting the volume using the volume setting device 20, the user is able to control the volume of sounds outputted from the full-range speakers SP1 and SP2.

[Full-Range Speakers SP1 and SP2 and Subwoofer]

The full-range speakers SP1 and SP2 and subwoofer SW are installed in the seat. The full-range speakers SP1 and SP2 are speakers that output high-band and mid-band sounds and are installed, for example, adjacent to the headrest of the seat so as to be bilaterally symmetrical. The subwoofer SW is a speaker that outputs low-band sounds and vibrations and is installed, for example, inside the seating portion of the seat. In the present embodiment, a case will be described in which the vibration output apparatus 1 outputs both low-band sounds and vibrations from the subwoofer SW. However, the subwoofer SW only has to be capable of outputting at least vibrations and does not necessarily have to output both vibrations and low-band sounds. As will be described later, the subwoofer SW outputs vibrations using signals (vibration signals) based on acoustic signals (input signals) outputted by the sound source playback device 10. For this reason, the basic configuration of the subwoofer SW is preferably based on a structure, such as a linear resonant actuator. Note that the full-range speakers SP1 and SP2 and/or subwoofer SW may be included in the configuration of the vibration output apparatus according to the embodiment of the present invention.

[First Amplifier and Second Amplifier]

The first amplifier 31 amplifies the acoustic signals volume-controlled by the volume controller 400 and outputs the amplified acoustic signals to the full-range speakers SP1 and SP2. The second amplifier 32 amplifies signals (vibration signals) upsampled by the upsampler 600 (to be discussed later) and outputs the amplified signals to the subwoofer SW. Note that the first amplifier 31 and/or second amplifier 32 may be included in the configuration of the vibration output apparatus according to the embodiment of the present invention.

[Downsampler and Upsampler]

The downsampler 100 acquires the acoustic signals for two channels outputted by the sound source playback device 10 and downsamples the acoustic signals and thus reduces the processing loads on the low-band processing unit 200, mid-band processing unit 300, and weight generator 500. In this downsampling process, the downsampler 100 downsamples the acoustic signals for two channels to a one-channel acoustic signal.

The downsampler 100 applies a low-pass filter to the acoustic signals and then decimates the sampling frequency. The downsampler 100 according to the present embodiment sets the sampling frequency to 48 kHz and sets the downsampling number (decimation number) to 16. The sampling frequency of the downsampled acoustic signal is 3 kHz. The downsampler 100 according to the present embodiment uses a 256-tap finite impulse response (FIR) filter as a low-pass filter and sets the cutoff frequency to 600 Hz in order to pass the low/mid-band components of the acoustic signals through the low-pass filter. FIG. 2A is a graph showing filter characteristics of the low-pass filter used by the downsampler 100 according to the present embodiment.

The upsampler 600 upsamples the acoustic signal (vibration signal) acoustically processed by the low-band processing unit 200, mid-band processing unit 300, and weight generator 500, under set conditions corresponding to the downsampling performed by the downsampler 100. Specifically, the upsampler 600 interpolates zeros between the samples decimated by upsampling, then eliminates the folded components using a low-pass filter similar to that of the downsampler 100, and thus upsamples the resulting signal to a sampling frequency similar to that of the sound source.

[Low-Band Processing Unit and Mid-Band Processing Unit]

The low-band processing unit 200 includes a low-band extractor (low-band signal generator) 210, a first envelope detector (low-band envelope signal calculator) 230, a first edge emphasizer (low-band edge processor) 240, and a first level corrector 250. The mid-band processing unit 300 includes a mid-band extractor (mid-band signal generator) 310, a frequency compressor 320, a second envelope detector (compressed envelope signal calculator) 330, a second edge emphasizer (compression edge processor) 340, and a second level corrector 350. Although different signals are inputted thereto, the first envelope detector 230 and second envelope detector 330 perform the same process. Similarly, although different signals are inputted thereto, the first edge emphasizer 240 and second edge emphasizer 340 perform the same process. Similarly, although different signals are inputted thereto, the first level corrector 250 and second level corrector 350 perform the same process. In the present embodiment, only the first envelope detector 230, first edge emphasizer 240, and first level corrector 250 will be described, and the second envelope detector 330, second edge emphasizer 340, and second level corrector 350 will not be described in detail.

The downsampler 100 outputs the downsampled acoustic signal to the low-band extractor 210 of the low-band processing unit 200 and the mid-band extractor 310 of the mid-band processing unit 300.

[Low-Band Extractor and Mid-Band Extractor]

The low-band extractor 210 extracts low-band frequency components from the downsampled acoustic signal by applying a band-pass filter for the low frequency band thereto. The mid-band extractor 310 extracts mid-band frequency components from the downsampled acoustic signal by applying a band-pass filter for the mid frequency band thereto.

Figure 2B:
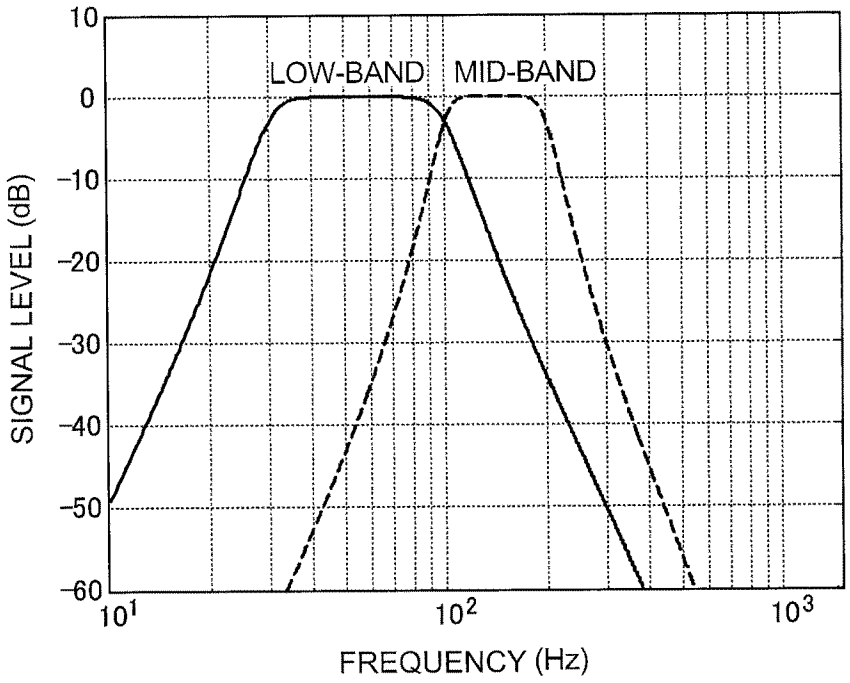
FIG. 2B is a graph showing filter characteristics of a band-pass filter for the low frequency band used by a low-band extractor according to the present embodiment and filter characteristics of a band-pass filter for the mid frequency band used by a mid-band extractor according to the present embodiment.
Figure 2A:
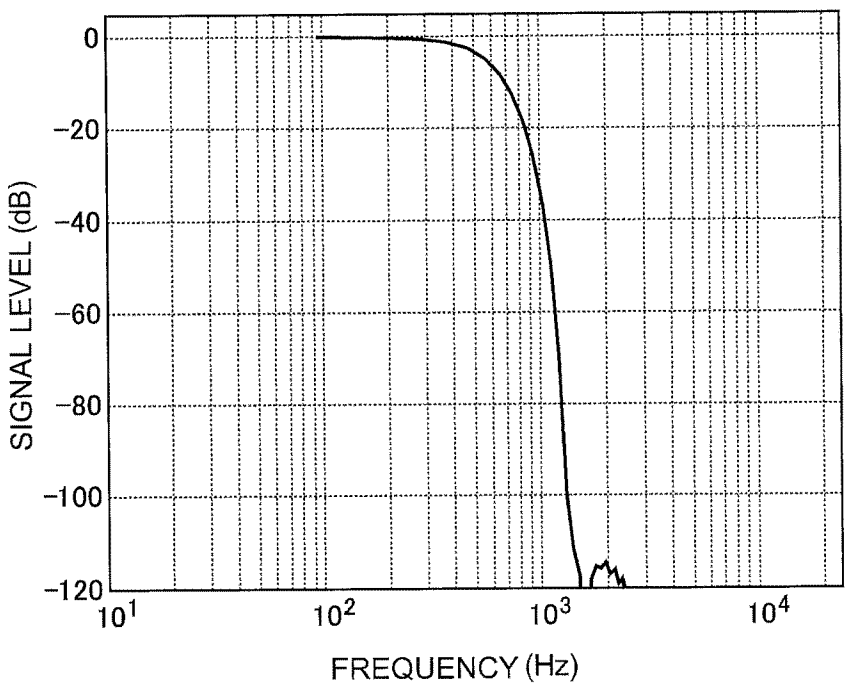
FIG. 2A is a graph showing filter characteristics of a low-pass filter used by a downsampler according to the present embodiment.

FIG. 2B is a graph showing filter characteristics of the band-pass filter for the low frequency band used by the low-band extractor 210 and those of the band-pass filter for the mid frequency band used by the mid-band extractor 310. The band-pass filters for the low frequency band and mid frequency band shown in FIG. 2B are quaternary Butterworth filters. For the band-pass filter for the low frequency band, the low band-side cutoff frequency is set to 30 Hz, and the high band-side cutoff frequency is set to 100 Hz. For the band-pass filter for the mid frequency band, the low band-side cutoff frequency is set to 100 Hz, and the high band-side cutoff frequency is set to 200 Hz.

The cutoff frequencies set for the band-pass filter for the low frequency band are values set considering the frequency range of vibrations. As described above, the frequency range of a vibration that humans are able to perceive through the tactile sense is about 10 to 150 Hz. For this reason, cutoff frequencies that fall within a frequency range of about 10 Hz to 150 Hz are set for the band-pass filter for the low frequency band. The low band-side cutoff frequency is set to 30 Hz rather than 10 Hz considering the fact that the user is less likely to perceive a low-frequency vibration. Also, the high band-side cutoff frequency is set to 100 Hz rather than 150 Hz. This is because if a vibration of around 150 Hz is outputted, the user may feel tickled, leading to a reduction in the perceptibility, or the user may feel that the vibration is uncomfortable.

The low-band extractor 210 outputs the acoustic signal (low band-extracted signal, low-band signal) consisting of the low-band frequency components extracted by the band-pass filter for the low frequency band to the first envelope detector 230. The mid-band extractor 310 outputs the acoustic signal (mid-band-extracted signal, mid-band signal) consisting of the mid-band frequency components extracted by the band-pass filter for the mid frequency band to the frequency compressor 320.

[First Envelope Detector and Second Envelope Detector]

The first envelope detector 230 first detects the absolute value of the acoustic signal (low band-extracted signal) consisting of the low-band frequency components extracted by the low-band extractor 210. The first envelope detector 230 then performs an integration process on the absolute value-detected, low band-extracted signal by applying a low-pass filter thereto and thus detects the envelope of the low band-extracted signal. The first envelope detector 230 according to the present embodiment uses a secondary Butterworth filter having a cutoff frequency of 10 Hz as the low-pass filter.

Figure 3:
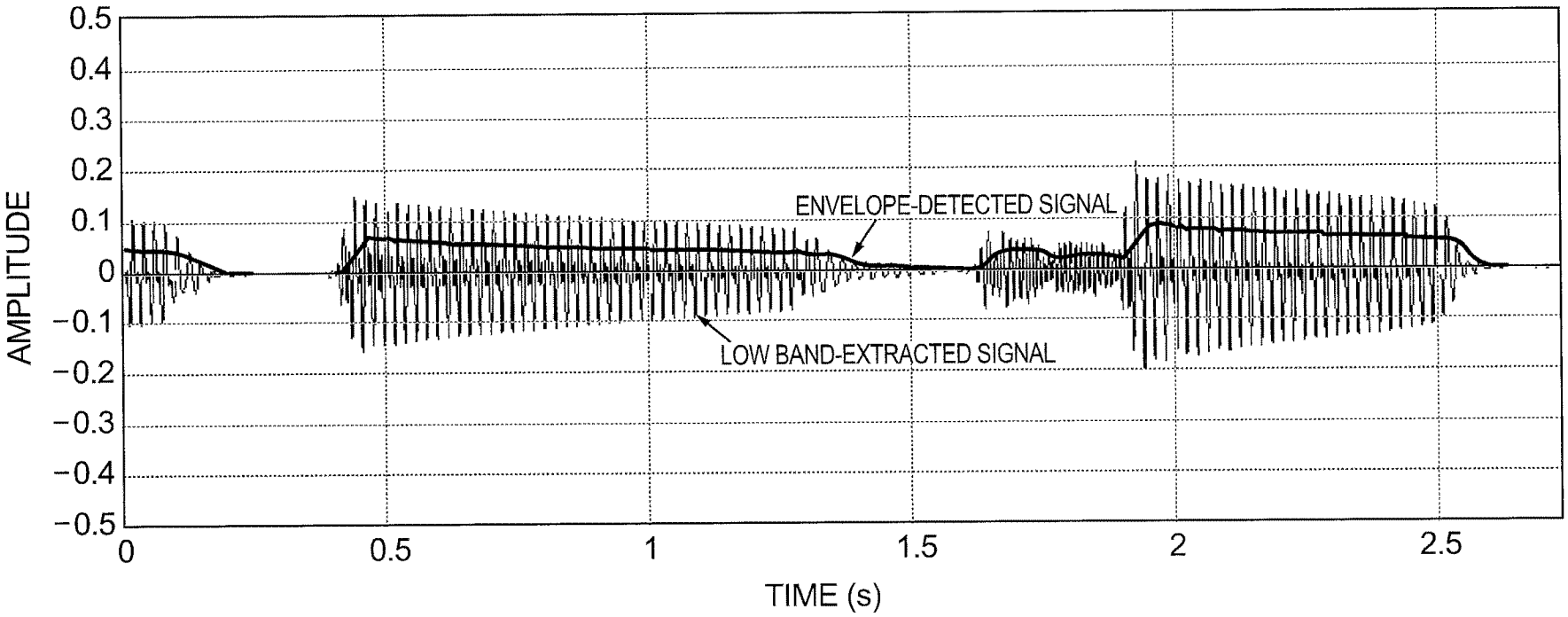
FIG. 3 is a graph showing a low band-extracted signal and an envelope-detected signal according to the present embodiment.

FIG. 3 is a graph showing the low band-extracted signal and an envelope-detected signal (low-band envelope signal) representing the detected envelope. FIG. 3 shows temporal changes in the amplitude value of the signals. As shown in FIG. 3, the envelope-detected signal is a baseband signal including direct-current components (consisting of positive components alone). The first envelope detector 230 outputs the low-band, envelope-detected signal to the first level corrector 250 and first edge emphasizer 240.

As with the first envelope detector 230, the second envelope detector 330 also detects the absolute value of the received signal and then detects the envelope thereof. Note that the second envelope detector 330 performs the above process on a compressed signal obtained by extracting the mid-band frequency components from the acoustic signal using the mid-band extractor 310 and compressing the frequency of the resulting signal using the frequency compressor 320 (to be discussed later). That is, the second envelope detector 330 detects the absolute value of the compressed signal and performs an integration process on the compressed signal by applying a low-pass filter thereto and thus detects the envelope thereof. The second envelope detector 330 then outputs the envelope-detected signal for the compressed signal (compressed envelope signal) to the second level corrector 350 and second edge emphasizer 340.

[First Edge Emphasizer and Second Edge Emphasizer]

The first edge emphasizer 240 generates an edge-emphasized (edge-processed), low band-extracted signal by emphasizing the edge of the low band-extracted signal received from the low-band extractor 210 using the low-band, envelope-detected signal received from the first envelope detector 230.

Figure 4:
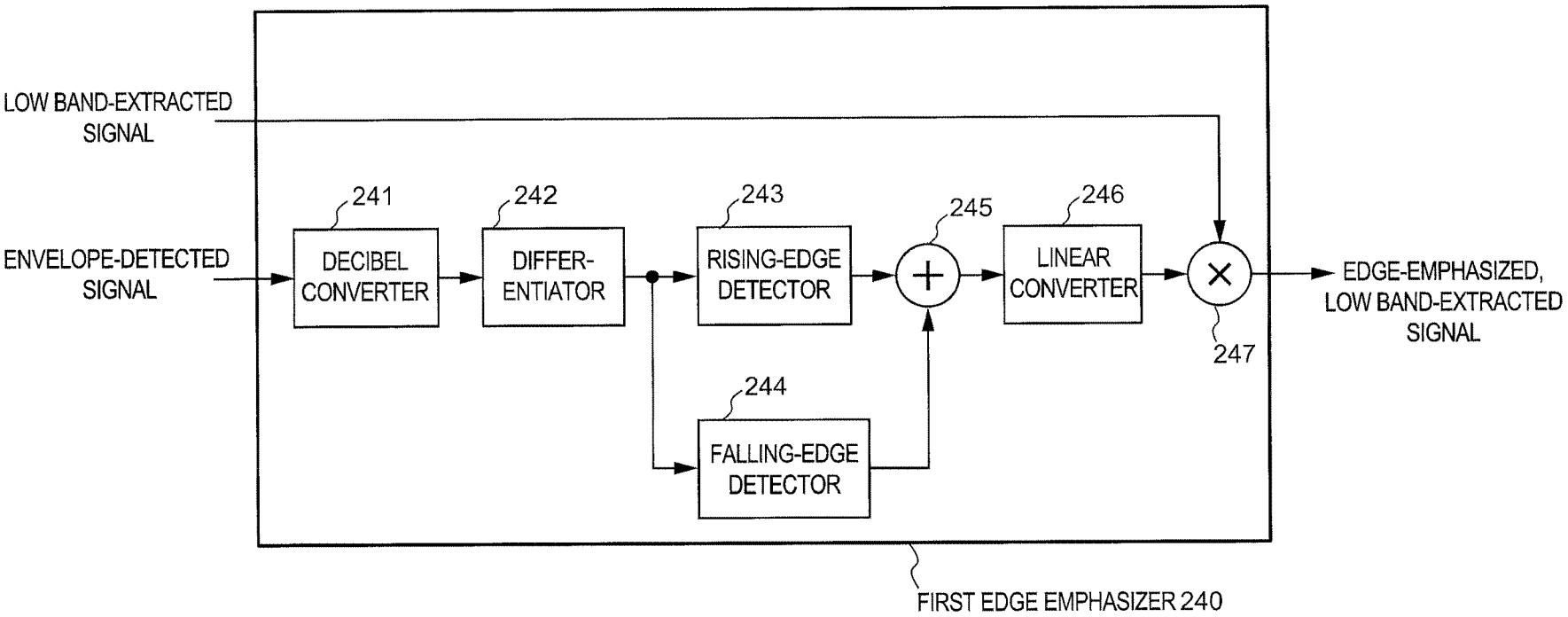
FIG. 4 is a block diagram showing a schematic configuration of a first edge emphasizer according to the present embodiment.

FIG. 4 is a block diagram showing a schematic configuration of the first edge emphasizer 240. The first edge emphasizer 240 includes a decibel converter 241, a differentiator 242, a rising-edge detector 243, a falling-edge detector 244, an adder 245, a linear converter 246, and a multiplier 247.

Figure 5:
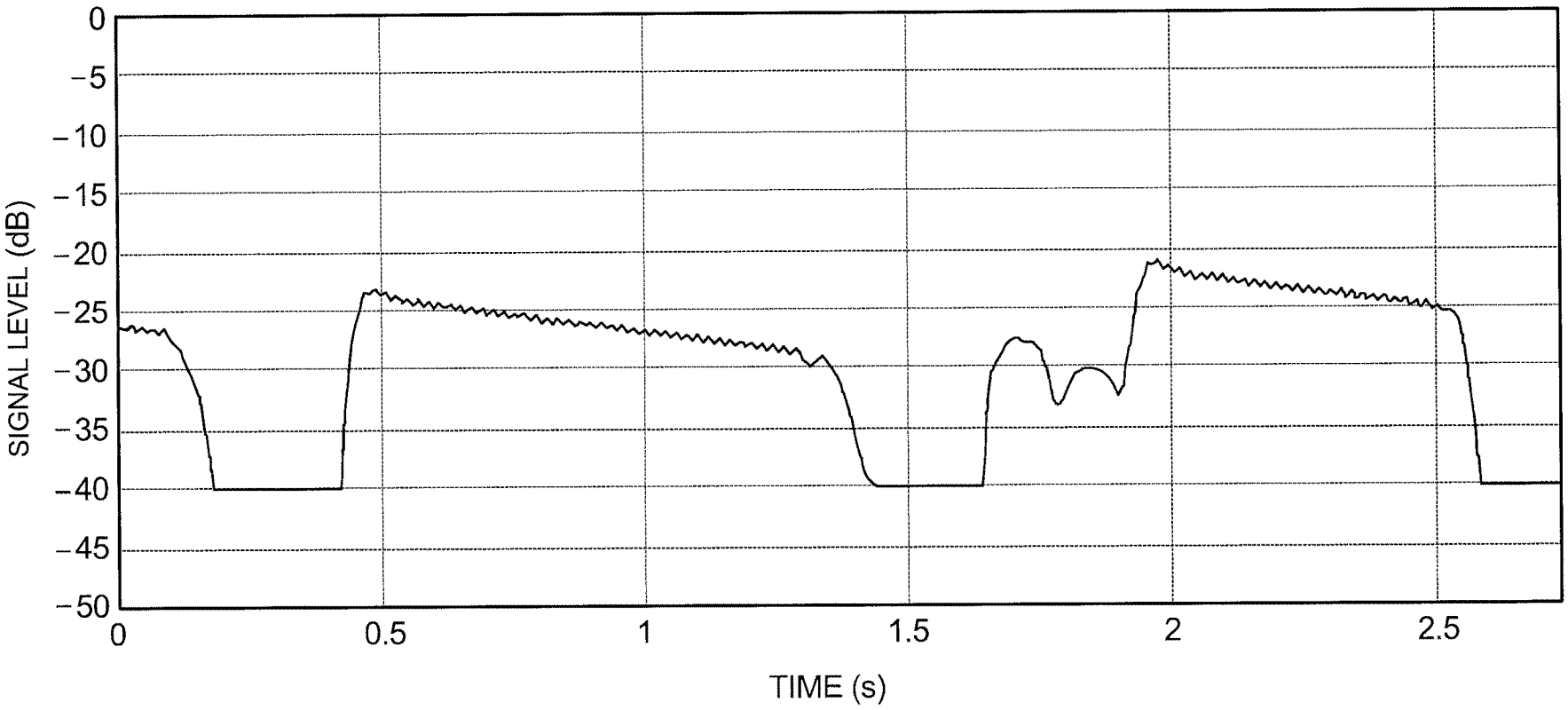
FIG. 5 is a graph showing the waveform (signal-level changes) of the decibel-converted, envelope-detected signal generated by a decibel converter according to the present embodiment.

The decibel converter 241 generates a decibel-converted, envelope-detected signal by converting (decibel conversion) the amplitude value of the envelope-detected signal received from the first envelope detector 230 into a decibel value thereof. FIG. 5 is a graph showing the waveform (signal-level changes) of the decibel-converted, envelope-detected signal generated by the decibel converter 241. As shown in FIG. 5, the decibel converter 241 limits the lower limit of the signal level to −40 dB during decibel conversion.

The differentiator 242 differentiates the decibel-converted, envelope-detected signal generated by the decibel converter 241 by applying a high-pass filter thereto. The rising response speed and falling response speed of the differentiated signal and the respective levels can be set by controlling the cutoff frequency and gain of the high-pass filter. The differentiator 242 according to the present embodiment uses a primary Butterworth filter as the high-pass filter.

The rising-edge detector 243 detects the rising edge by extracting only a signal having a level equal to or higher than zero on the basis of the level of the differentiated, envelope-detected signal generated by the differentiator 242 and generates a rising-edge signal. The falling-edge detector 244 detects the falling edge by extracting only a signal having a level equal to or lower than zero on the basis of the level of the differentiated, envelope-detected signal generated by the differentiator 242 and generates a falling-edge signal.

Figure 6:
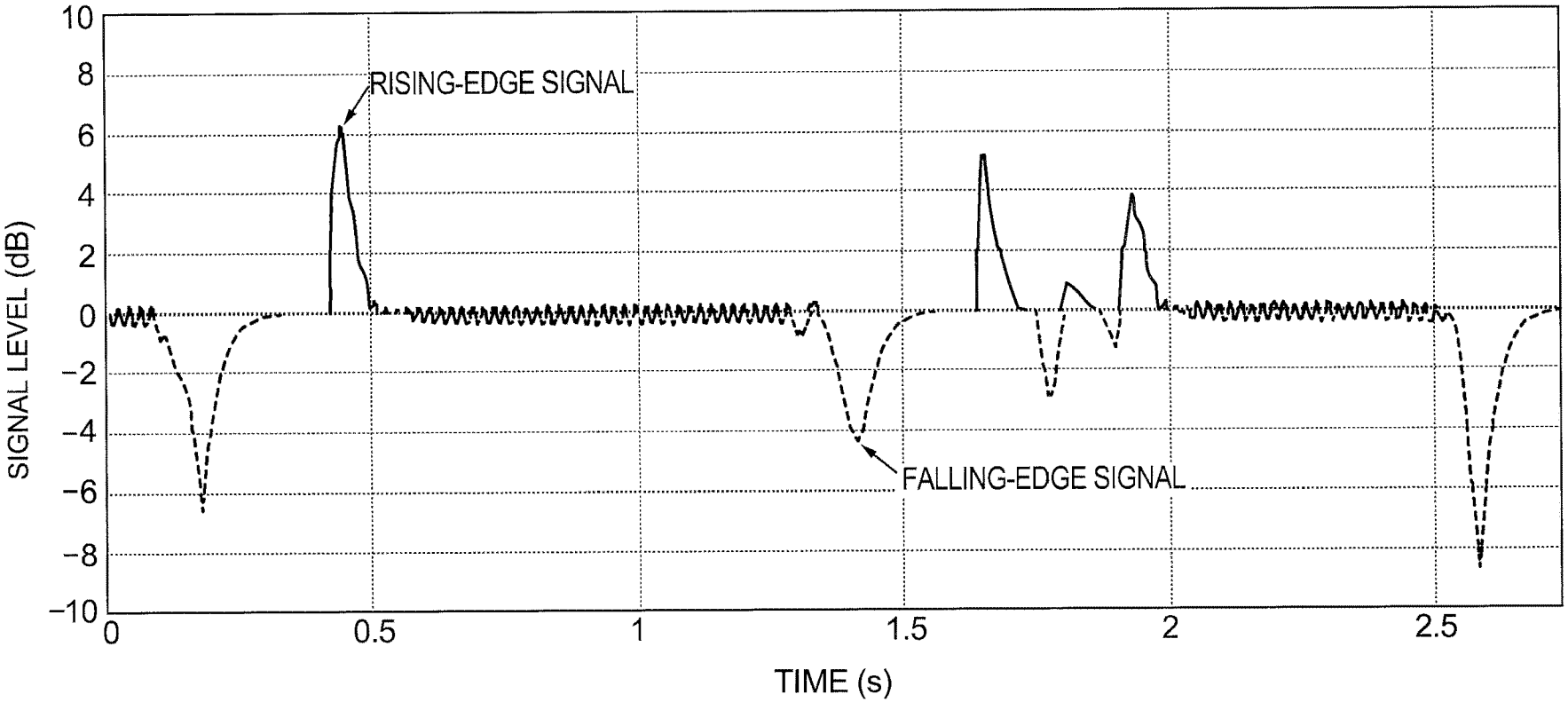
FIG. 6 is a graph showing the waveforms (signal-level changes) of a rising-edge signal and a falling-edge signal according to the present embodiment.

FIG. 6 is a graph showing the waveforms (signal-level changes) of the rising-edge signal and falling-edge signal. As shown in FIG. 6, for the rising edge signal, the level of the portions other than the rising portion, whose level is negative, becomes zero. For the falling edge signal, the level of the portions other than the falling portion, whose level is positive, becomes zero.

The adder 245 generates an edge-detected signal whose level rises and falls in accordance with the rising and falling of the envelope-detected signal by combining (adding up) the rising-edge signal generated by the rising-edge detector 243 and the falling-edge signal generated by the falling-edge detector 244. The linear converter 246 generates an edge-emphasized signal by linearly converting the edge-detected signal generated by the adder 245. The multiplier 247 generates an edge-emphasized, low band-extracted signal by multiplying the acoustic signal (low band-extracted signal)

consisting of the low-band frequency components extracted by the low-band extractor 210, by the edge-emphasized signal.

Figure 7:
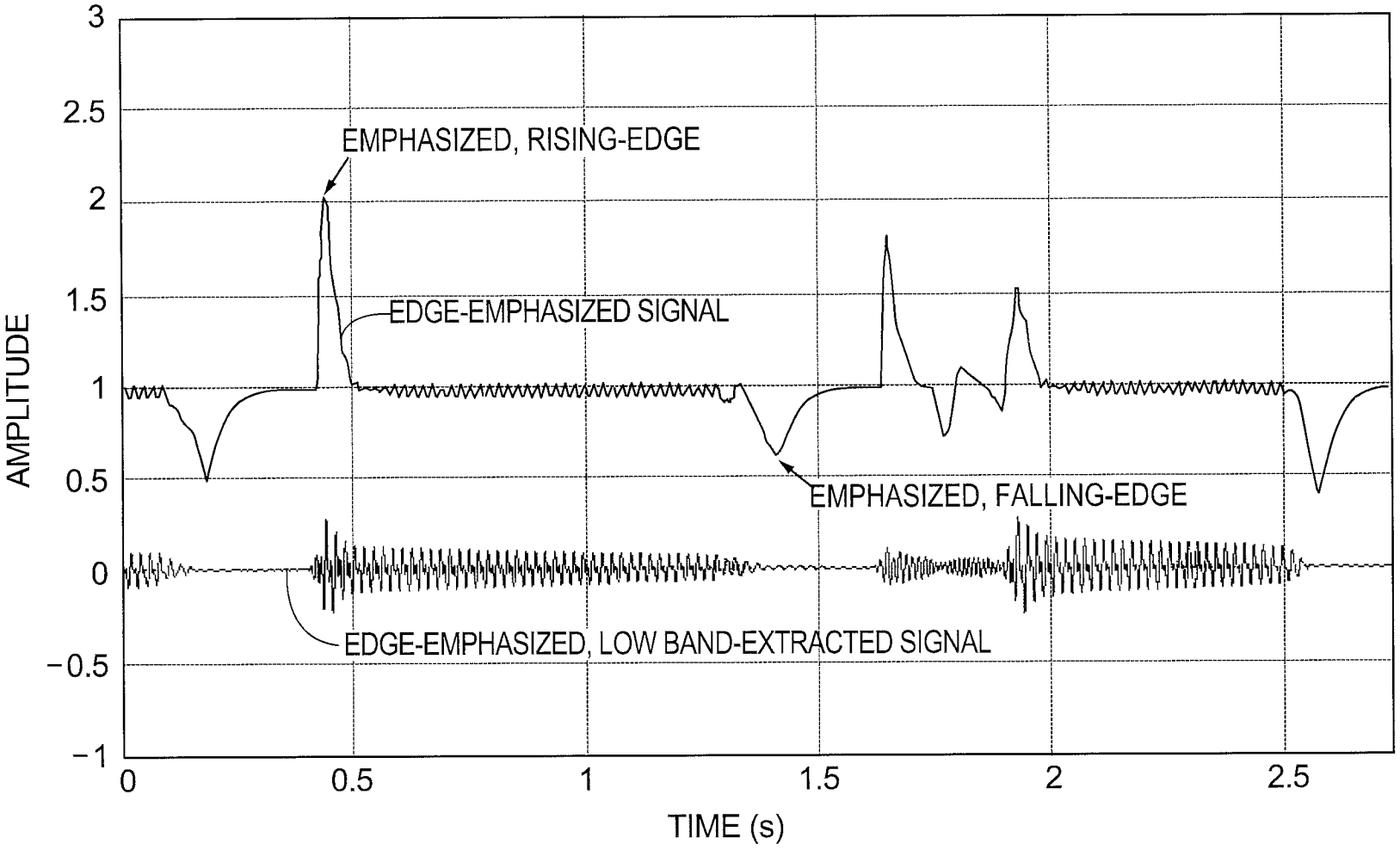
FIG. 7 is a graph showing changes in the amplitude of an edge-emphasized signal and an edge-emphasized, low band-extracted signal according to the present embodiment.

FIG. 7 is a graph showing changes in the amplitude of the edge-emphasized signal and the edge-emphasized, low band-extracted signal. As shown in FIG. 6, the level of both the rising-edge signal and falling-edge signal is around 0 dB in the times other than the rising times and falling times. Accordingly, the edge-emphasized signal obtained by, using the linear converter 246, linearly converting the edge-detected signal generated by combining (adding up) the rising-edge signal and falling-edge signal using the adder 245 is a signal having a reference amplitude of 1.

In the edge-emphasized, low band-extracted signal shown in FIG. 7, the rising edges and falling edges are emphasized compared to the low band-extracted signal shown in FIG. 3. Specifically, the amplitude of the low band-extracted signal in the rising times is emphasized (the amplitude is instantaneously increased), and the amplitude of the low band-extracted signal in the falling times is suppressed (the amplitude is instantaneously decreased).

By emphasizing the edge in this manner, the low band-extracted signal having relatively uniform amplitude characteristics as shown in FIG. 3 is accentuated. Thus, when the subwoofer SW outputs a vibration on the basis of such a low band-extracted signal, it is possible to cause the user to perceive the vibration with higher perceptibility. In particular, since the vibration starts so as to vary greatly instantaneously and ceases without lingering, the user is more likely to feel that the vibration is accentuated, resulting in an increase in the perceptibility of the vibration.

Since the auditory sense and tactile sense have different dynamic ranges, the user perceives changes in the vibration level of a vibration to a degree much different from the degree to which the user perceives changes in the signal level of a sound. For this reason, unless changes in the level (changes in the amplitude) of the acoustic signal-based vibration signal to be perceived as a vibration are increased compared to changes in the level (changes in the amplitude) of the acoustic signal to be perceived as a sound, the user may perceive the vibration weakly. In this respect, emphasizing the edge of the signal for outputting the vibration is very effective in causing the user to perceive the vibration with higher perceptibility.

The first edge emphasizer 240 outputs the generated edge-emphasized, low band-extracted signal to the first level corrector 250.

As with the first edge emphasizer 240, the second edge emphasizer 340 includes a decibel converter, a differentiator, a rising-edge detector, a falling-edge detector, an adder, a linear converter, and a multiplier. The second edge emphasizer 340 receives the compressed signal obtained by compressing the frequency of the mid-band-extracted signal using the frequency compressor 320. The second edge emphasizer 340 generates an edge-emphasized, compressed signal by emphasizing the edge of the compressed signal using the envelope-detected signal for the compressed signal received from the first envelope detector 330. The second edge emphasizer 340 then outputs the generated edge-emphasized, compressed signal to the second level corrector 350.

[First Level Corrector and Second Level Corrector]

Figure 8:
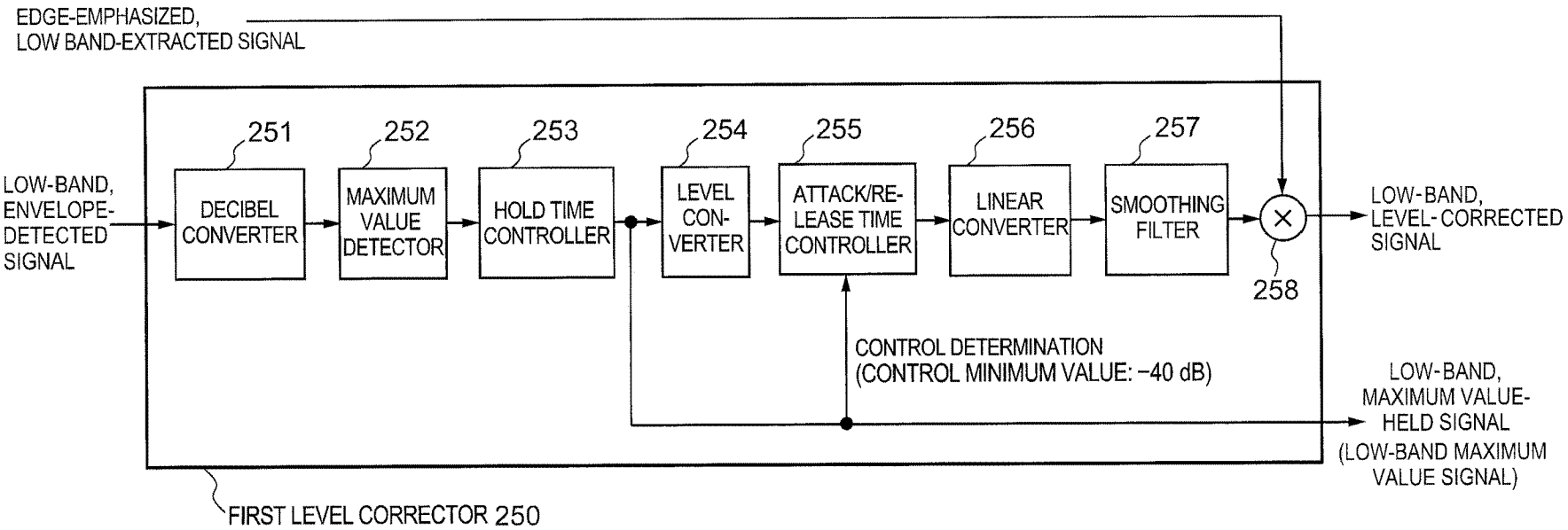
FIG. 8 is a block diagram showing a schematic configuration of a first level corrector according to the present embodiment.

The first level corrector 250 corrects the level of the edge-emphasized, low band-extracted signal received from the first edge emphasizer 240. FIG. 8 is a block diagram showing a schematic configuration of the first level corrector 250. The first level corrector 250 includes a decibel converter 251, a maximum value detector 252, a hold time controller 253, a level converter 254, an attack/release time controller 255, a linear converter 256, a smoothing filter unit 257, and a multiplier 258. Table 2 of FIG. 21A shows the parameters of a process performed by the functional elements of the first level corrector 250.

The decibel converter 251 generates a decibel-converted, envelope-detected signal by converting the amplitude value of the low-band, envelope-detected signal received from the first envelope detector 230 into a decibel value thereof. The maximum value detector 252 detects the maximum value of the decibel-converted, envelope-detected signal generated by the decibel converter 251 by shifting the decibel-converted, envelope-detected signal corresponding to one frame (e.g., 128 samples for the decibel converter 251; see Table 2 of FIG. 21A) on a sample by sample basis.

The hold time controller 253 holds the maximum value detected by the maximum value detector 252 by a predetermined time. For example, the hold time controller 253 holds the maximum value by 0.5 sec (see Table 2 of FIG. 21A). The hold time controller 253 then outputs the signal whose maximum value has been held (low-band, maximum value-held signal, low-band maximum value signal) to the level converter 254, attack/release time controller 255, and weight generator 500.

Figure 9:
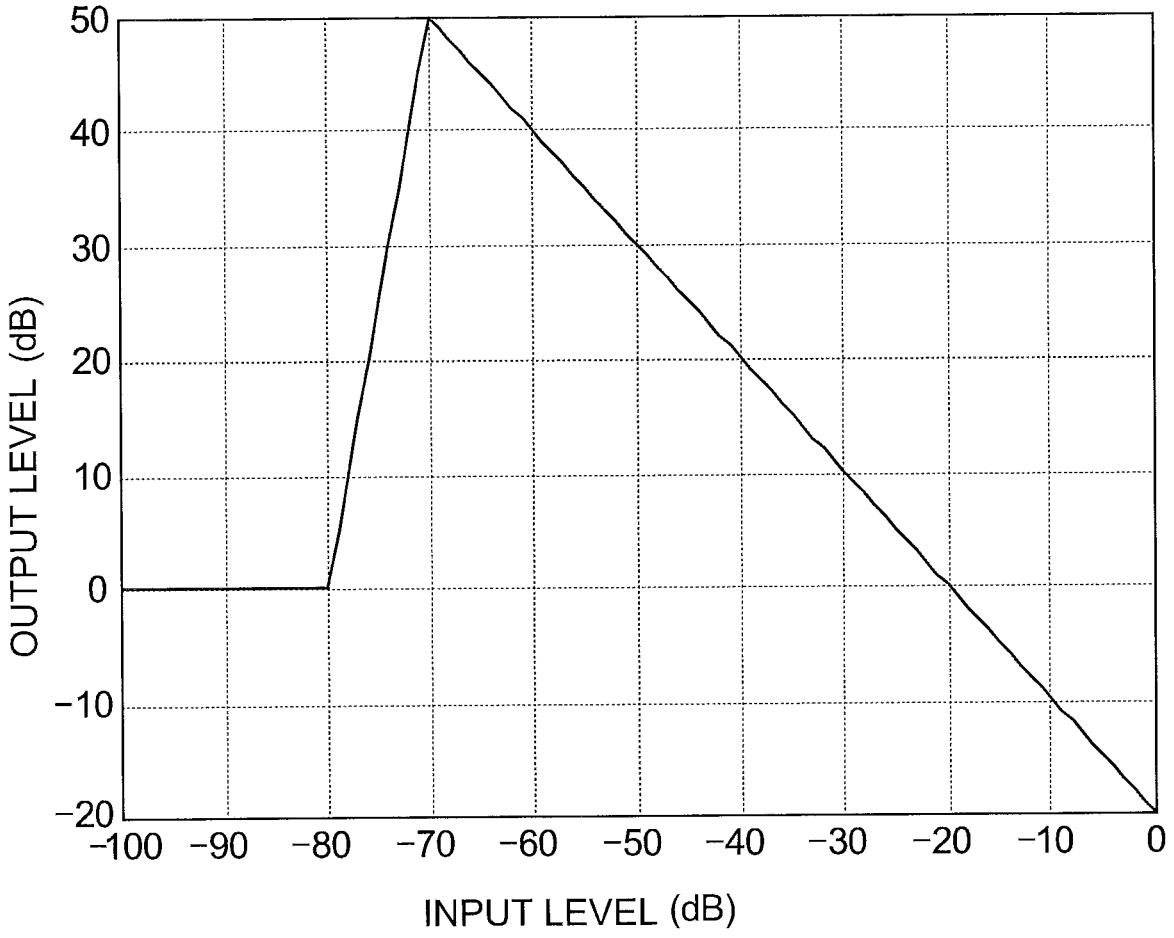
FIG. 9 is a graph showing an input/output conversion table of a level converter according to the present embodiment.

The level converter 254 includes an input/output conversion table. The level converter 254 converts the level of the signal (low-band, maximum value-held signal, low-band maximum value signal) received from the hold time controller 253 on the basis of the input/output conversion table and outputs the resulting signal to the attack/release time controller 255. FIG. 9 is a graph showing the input/output conversion table of the level converter 254. The horizontal axis represents the level of the input signal (input level; in dB), and the vertical axis represents the level of the converted signal (output signal) (output level; in dB).

When the level converter 254 receives an input signal having a level (input level) of −70 to 0 dB, it converts the input signal into an output signal having a level (output level) of 50 to −20 dB on the basis of the input/output conversion table so that the level of the signal to be outputted to the attack/release time controller 255 is inversely proportional to the level of the input signal. That is, as the level of the input signal is increased from −70 to 0 dB, the level of the output signal is reduced from 50 to −20 dB.

When the level converter 254 receives an input signal having a level (input level) of −80 to −70 dB, it converts the input signal into an output signal having a level (output level) of 0 to 50 dB so that the level of the signal to be outputted to the attack/release time controller 255 is proportional to the level of the input signal. That is, as the level of the input signal is increased from −80 to −70 dB, the level of the output signal is increased from 0 to 50 dB.

When the level converter 254 receives an input signal having a level (input level) equal to or lower than −80 dB, it converts the input signal into an output signal having a level (output level) of 0 dB and outputs it to the attack/release time controller 255.

The attack/release time controller 255 performs response control corresponding to a predetermined attack time and a predetermined release time (attack/release time control) on the signal acquired from the level converter 254. As used herein, the term "attack time control" refers to a process of controlling the time required for the signal level to rise, and the term "release time control" refers to a process of controlling the time required for the signal level to fall to the minimum level. For example, the attack/release time controller 255 sets the attack time to, for example, 0.5 sec and sets the release time to, for example, 10 sec (see Table 2 of FIG. 21A) to perform attack time control and release time control.

The attack/release time controller 255 also uses a primary Butterworth low-pass filter to perform attack time control and release time control. The attack time and release time are set by setting the filter coefficients of the Butterworth low-pass filter. The attack/release time controller 255 according to the present embodiment sets the attack time to 0.5 sec by setting the cutoff frequency to 2 Hz. Also, the attack/release time controller 255 sets the release time to 10 sec by setting the cutoff frequency to 0.1 Hz.

As described above, the attack/release time controller 255 receives the maximum value-held signal from the hold time controller 253. The attack/release time controller 255 determines whether the level of the maximum value-held signal (low-band, maximum value-held signal, low-band maximum value signal) is a preset control minimum value (control determination). For example, the attack/release time controller 255 sets the control minimum value to −40 dB (see Table 2 of FIG. 21A).

If the level of the low-band, maximum value-held signal is equal to or lower than −40 dB (control minimum value), the attack/release time controller 255 stops the attack time control and release time control. Thus, the attack/release time controller 255 is able to control the extent to which the first level corrector 250 corrects the low band-extracted signal whose amplitude varies greatly and thus to prevent the correction made by the first level corrector 250 from becoming overcontrol. The attack/release time controller 255 then outputs, to the linear converter 256, the signal that has been subjected to attack/release time control or the signal that has yet to be subjected to attack/release time control on the basis of a determination that the level of the maximum value-held signal is equal to or smaller than the control minimum value.

The linear converter 256 converts the signal subjected to attack/release time control by the attack/release time controller 255 into a linear signal and outputs the linear signal to the smoothing filter unit 257. The smoothing filter unit 257 applies a smoothing filter to the signal received from the linear converter 256. Specifically, the smoothing filter unit 257 smooths the signal using the smoothing filter such that the signal (control signal) updated at the maximum value detection interval of the maximum value detector 252 is updated on a sample-by-sample basis. The smoothing filter unit 257 then outputs the smoothed signal to the multiplier 258.

The multiplier 258 corrects the level of the low band-extracted signal by multiplying the edge-emphasized, low band-extracted signal received from the first edge emphasizer 240 by the smoothed signal received from the smoothing filter unit 257. The multiplier 258 then outputs the level-corrected, low band-extracted signal to the weight generator 500 as a low-band, level-corrected signal.

Figure 10:
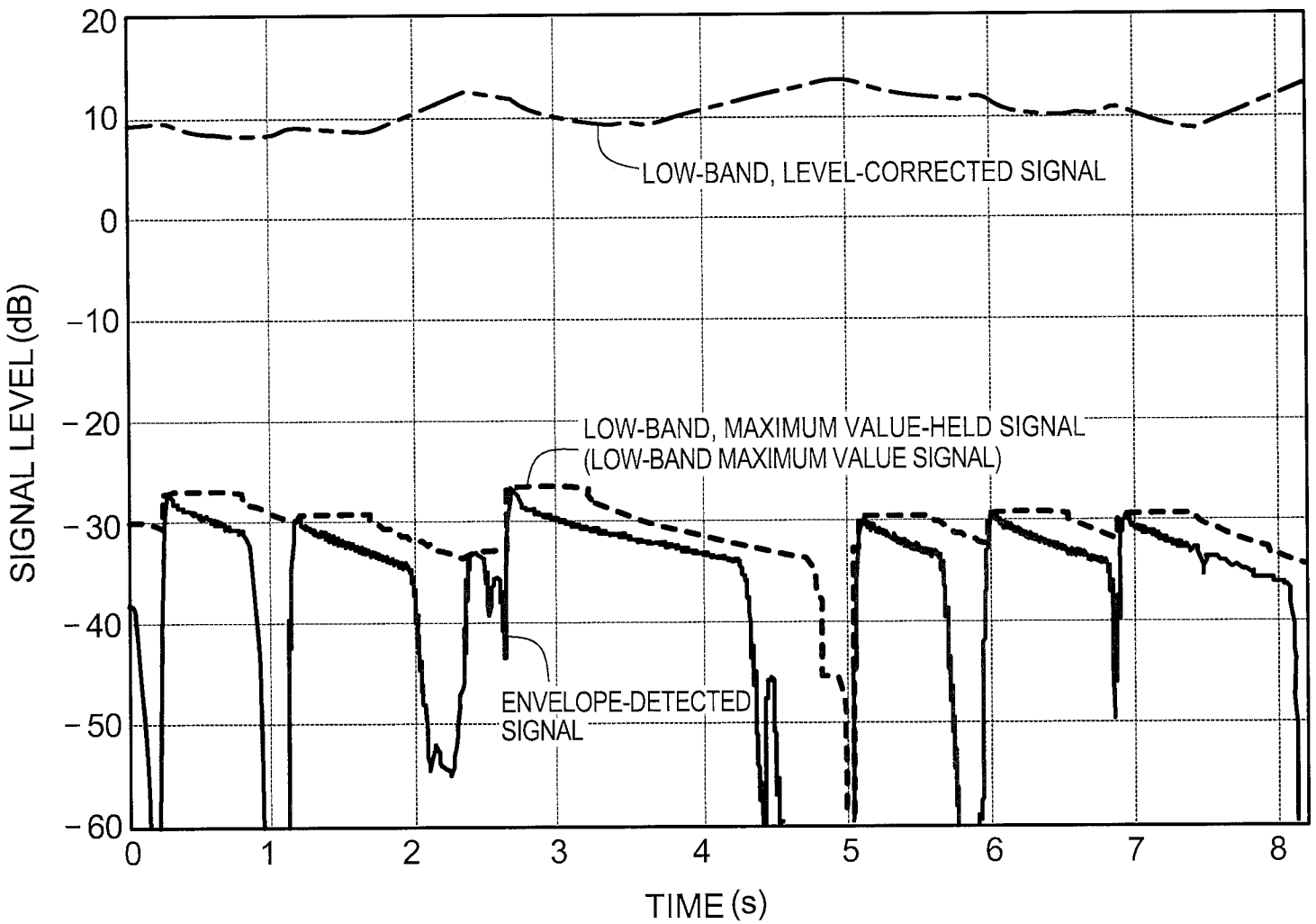
FIG. 10 is a graph showing temporal changes in the level of the envelope-detected signal, a low-band, maximum value-held signal, and a low-band, level-corrected signal according to the present embodiment.

FIG. 10 is a graph showing temporal changes in the level of the low-band, the envelope-detected signal generated by the first envelope detector 230, the low-band, maximum value-held signal (low-band maximum value signal) generated by the hold time controller 253, and the low-band, level-corrected signal generated by the multiplier 258. The horizontal axis of FIG. 10 represents the time, and the vertical axis thereof represents the signal level in decibel (dB). As shown in FIG. 10, the maximum value-held signal is shown as a signal obtained by holding the maximum value of the envelope-detected signal for a predetermined time. The low-band, level-corrected signal is a signal obtained by performing level conversion, attack time control, release time control, and smoothing on the low-band, maximum value-held signal.

Figure 11A:
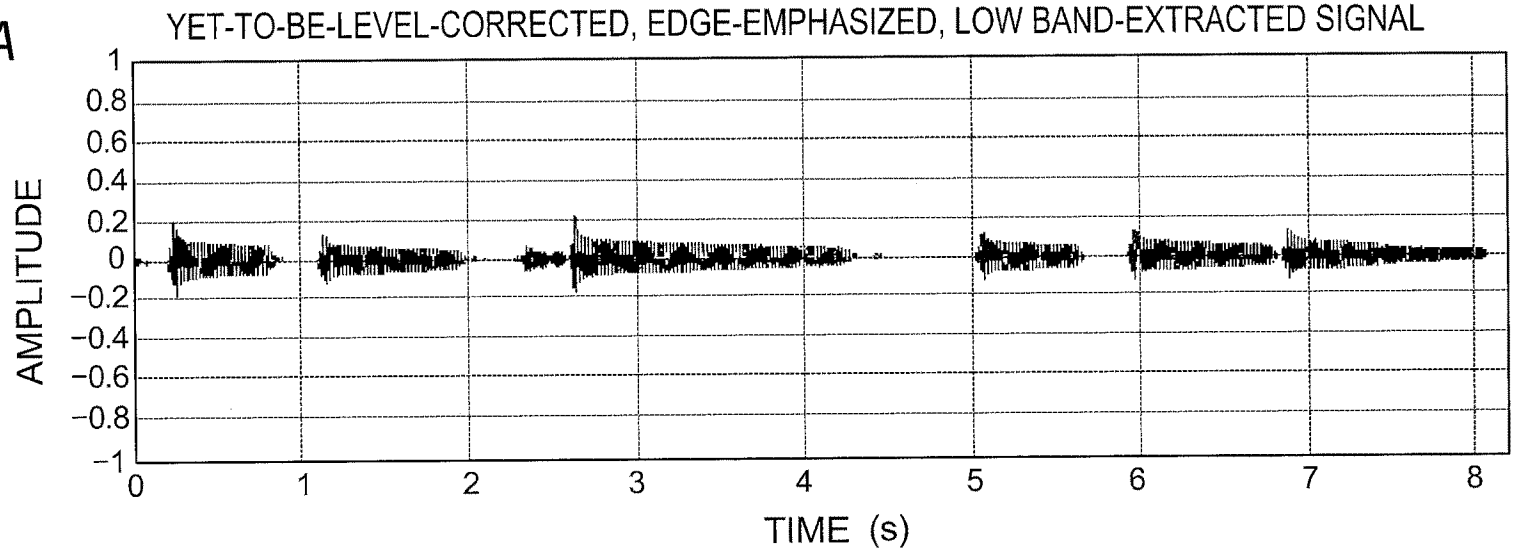
FIG. 11A is a graph showing changes in the amplitude of the edge-emphasized, low band-extracted signal generated by the first edge emphasizer according to the present embodiment that has not been level-corrected on the basis of the level-corrected signal.
Figure 11B:
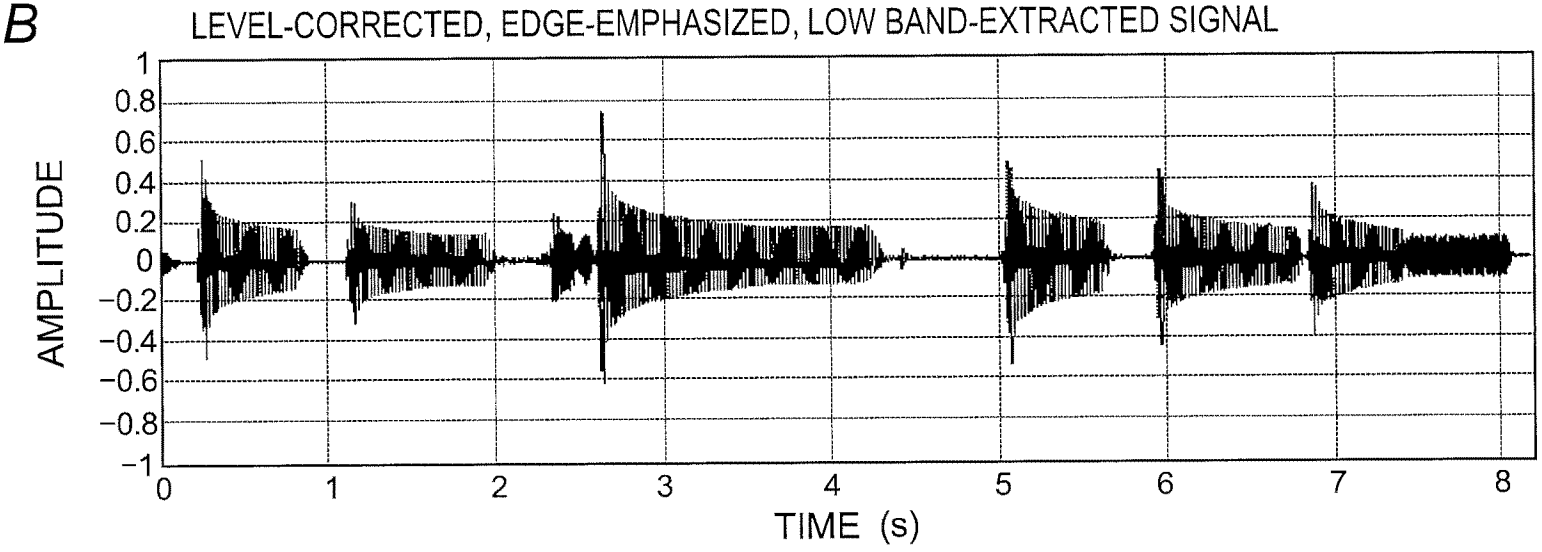
FIG. 11B is a graph showing changes in the amplitude of the edge-emphasized, low band-extracted signal generated by the first edge emphasizer according to the present embodiment that has been level-corrected on the basis of the level-corrected signal.

FIGS. 11A and 11B are graphs showing changes in the amplitude of the edge-emphasized, low-band-extracted signal generated by the first edge emphasizer 240 (the yet-to-be-level-corrected, edge-emphasized, low band-extracted signal; FIG. 11A) and the low-band, level-corrected signal generated by the first level corrector 250 (the level-corrected, edge-emphasized, low band-extracted signal; FIG. 11B). As shown in FIGS. 11A and 11B, in the level-corrected, edge-emphasized, low band-extracted signal, the rising edges and falling edges are emphasized compared to those of the yet-to-be-level-corrected, edge-emphasized, low band-extracted signal. Also, the level of the level-corrected, edge-emphasized, low band-extracted signal is higher than that of the yet-to-be-level-corrected signal by about 10 dB. That is, FIGS. 11A and 11B show that the amplitude value of the level-corrected signal is higher than that of the yet-to-be-level-corrected signal.

Use of the low-band, level-corrected signal allows for increasing the level of the signal used by the subwoofer SW to output a vibration. Thus, even if the acoustic signal received from the sound source playback device 10 is a signal for causing the user to perceive music through the auditory sense and the frequency range and dynamic ranges (level difference) of a vibration perceivable through the tactile sense are lower than those of a sound perceivable through the auditory sense as shown in Table 1 of FIG. 22B, the vibration output apparatus 1 is able to compensate for the differences in frequency range and dynamic range by edge emphasis and level correction and thus to cause the user to perceive the vibration with higher perceptibility.

As with the first level corrector 250, the second level corrector 350 also includes a decibel converter, a maximum value detector, a hold time controller, a level converter, an attack/release time controller, a linear converter, a smoothing filter unit, and a multiplier. The second level corrector 350 corrects the level of the edge-emphasized compressed signal received from the second edge emphasizer 340.

The first level corrector 250 outputs the generated low-band, level-corrected signal and low-band, maximum value-held signal (low-band maximum value signal) to the weight generator 500. The second level corrector 350 outputs the generated compressed, level-corrected signal and maximum value-held signal for the compressed signal (compressed maximum value signal) to the weight generator 500.

[Frequency Compressor]

Next, the frequency compressor 320 will be described. The frequency compressor 320 is not included in the low-band processing unit 200 and is included only in the mid-band processing unit 300. As shown in FIG. 1, the frequency compressor 320 compresses the frequency of the acoustic signal consisting of the mid-band frequency components extracted by the mid-band extractor 310. The frequency compressor 320 outputs the frequency-compressed signal (compressed signal) to the second envelope detector 330 and second edge emphasizer 340.

Figure 12:
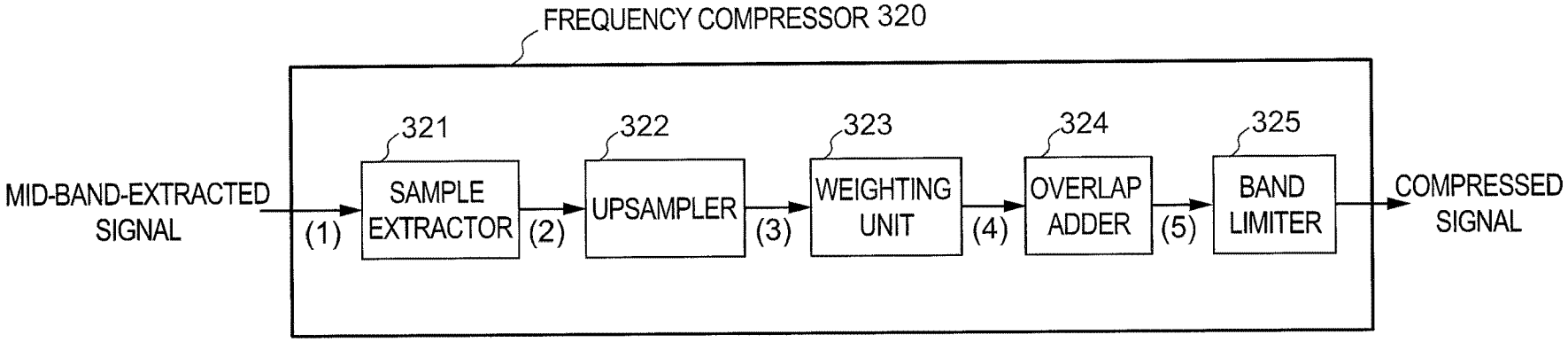
FIG. 12 is a block diagram showing a schematic configuration of a frequency compressor of the present embodiment.

FIG. 12 is a block diagram showing a schematic configuration of the frequency compressor 320. The frequency compressor 320 includes a sample extractor 321, an upsampler 322 for compression, a weighting unit 323 for compression, an overlap adder 324, and a band limiter 325 for compression. Table 3 of FIG. 21B shows the parameters of a process performed by the functional elements of the frequency compressor 320.

Figure 13:
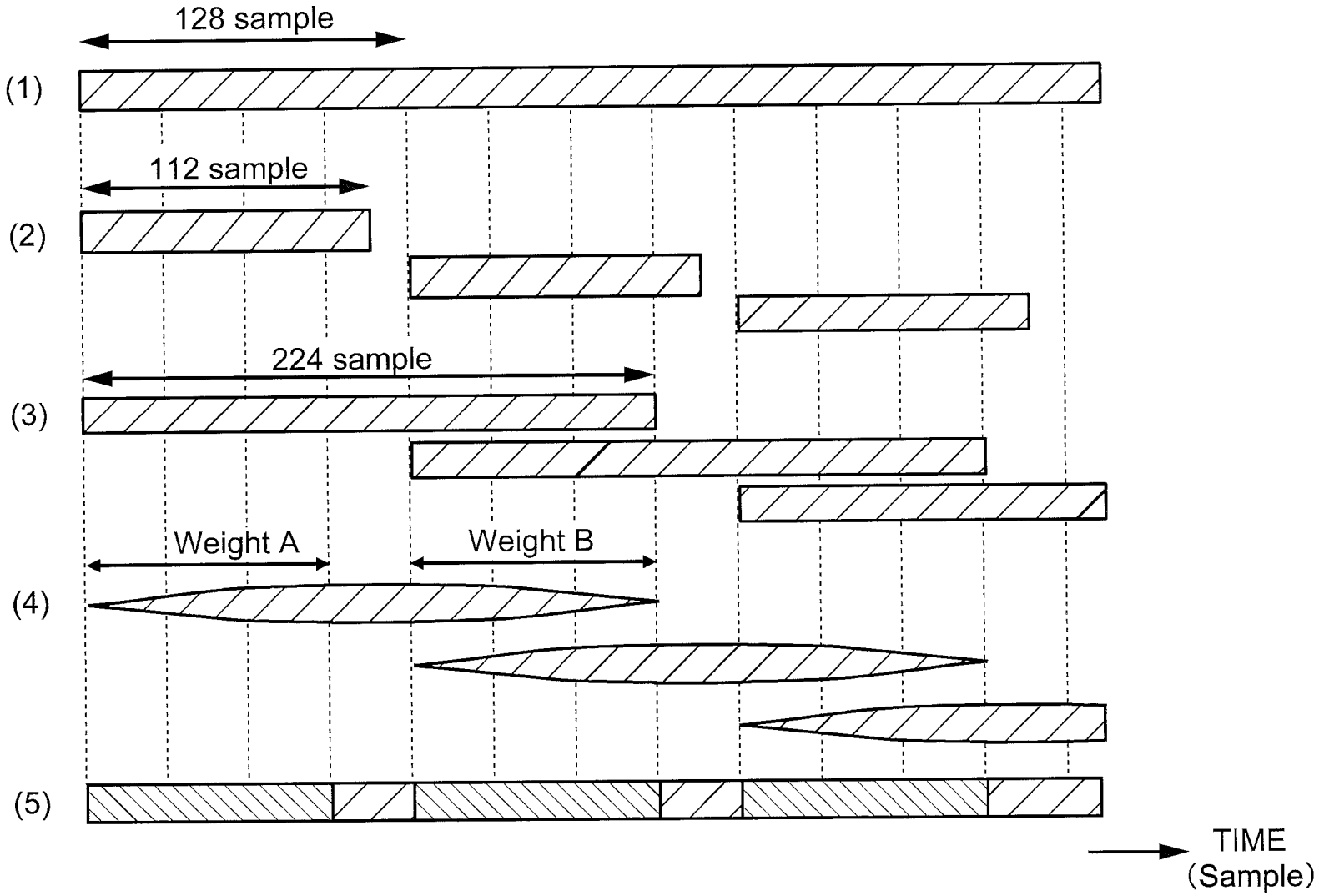
FIG. 13 is a diagram schematically showing the states of signals processed by the functional elements of the frequency compressor according to the present embodiment.

FIG. 13 is a diagram schematically showing the state of the signal processed by the functional elements of the frequency compressor 320. In FIG. 13, (1) shows the state of the mid-band-extracted signal generated by the mid-band extractor 310, (2) shows the state of the sample-extracted signal generated by the sample extractor 321, (3) shows the state of the upsampled signal generated by the upsampler 322, (4) shows the state of the weighted signal generated by the weighting unit 323, and (5) shows the state of the overlapped signal generated by the overlap adder 324.

The sample extractor 321 extracts a predetermined number of samples from the mid-band-extracted signal generated by the mid-band extractor 310 in a predetermined cycle. The sample extractor 321 according to the present embodiment sets the predetermined number to 112 samples as shown in Table 3 of FIG. 21B. Accordingly, the sample extractor 321 extracts 112 samples from the received mid-band-extracted signal each time.

(2) of FIG. 13 schematically shows a state in which 112 samples are extracted from the temporally continuing mid-band-extracted signal shown in (1) and subsequent 112 samples are continuously extracted after a lapse of the time corresponding to 128 samples following the start of extraction. The sample extractor 321 outputs the sample-extracted signal to the upsampler 322.

The upsampler 322 upsamples the sample-extracted signal received from the sample extractor 321. The upsampler 322 performs, on the sample-extracted signal, an upsampling process different from a typical sampling rate conversion process in which a signal sampled at one sampling frequency is converted into a signal sampled at another sampling frequency.

In the typical sampling rate conversion process, the amount of data per unit time is changed without changing the temporal length of the signal (the temporal amount of data). In a typical upsampling process, the amount of data per unit time is increased.

On the other hand, in the upsampling process realized by the upsampler 322, the amount of data of the signal is temporally increased by increasing the amount of data while maintaining the amount of data per unit time rather than changing the amount of data per unit time.

In (2) of FIG. 13, the temporal length of the signals obtained by extracting 112 samples from the mid-band-extracted signal is shown on the horizontal axis. (3) of FIG. 13 shows the signals upsampled by the upsampler 322. The temporal length of the signals shown in (3) is twice the temporal length of the signals shown in (2). As shown in (2) and (3) of FIG. 13, the upsampler 322 obtains the upsampled signals by doubling the temporal length of the yet-to-be-upsampled signals without increasing the amount of data per unit time.

Figure 14A:
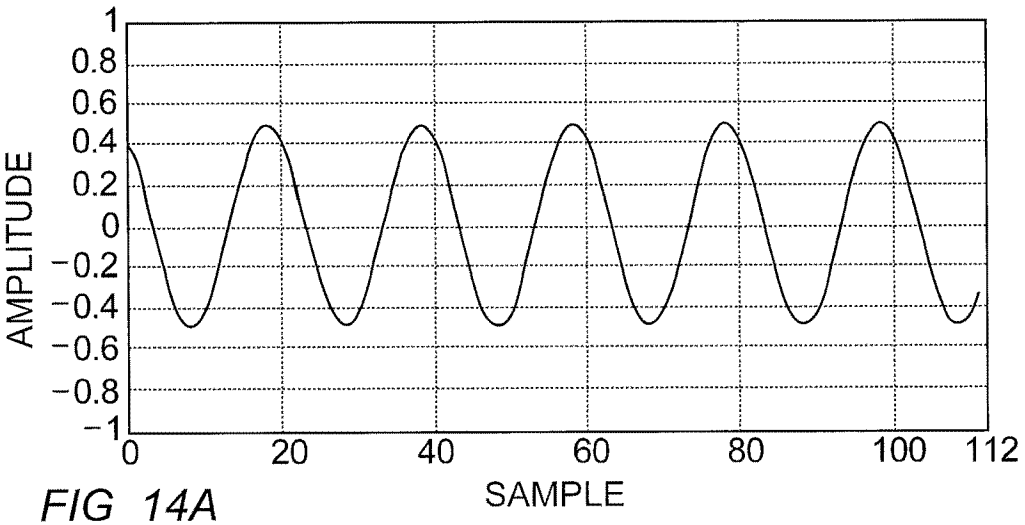
FIG. 14A is a graph showing the waveform of a signal consisting of 112 samples extracted by a sample extractor according to the present embodiment.
Figure 14B:
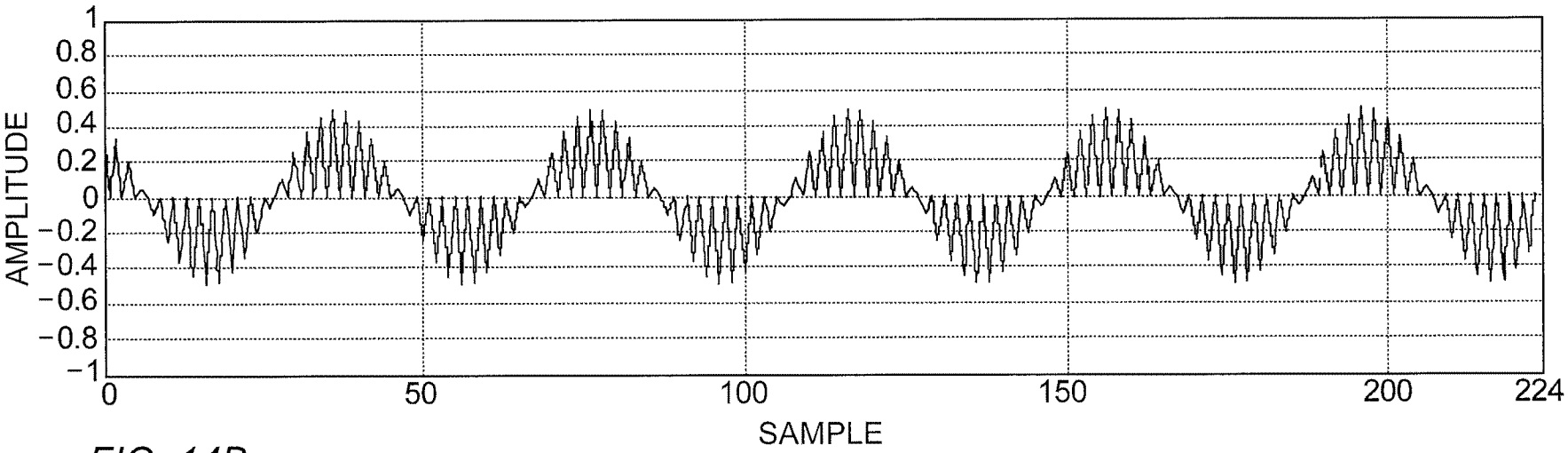
FIG. 14B is a graph showing the waveform of a signal that has been upsampled into 224 samples by an upsampler according to the present embodiment.

FIGS. 14A and 14B are graphs showing a specific upsampling process performed by the sample extractor 321 and upsampler 322. The sample extractor 321 first extracts a waveform corresponding to 112 samples from the mid-band-extracted signal generated by the mid-band extractor 310. FIG. 14A is a graph showing the waveform of a signal consisting of the 112 samples extracted by the sample extractor 321 and shows a case in which 112 samples have been extracted from the mid-band-extracted signal consisting of a sine wave with 150 Hz. The mid-band-extracted signal includes amplitude information of multiple samples arranged in a time sequence.

The upsampler 322 then upsampler the extracted 112 samples into a signal consisting of a total of 224 samples by interpolating amplitude information of zero (amplitude information for interpolation) between the extraction points of the 112 samples. FIG. 14B shows the waveform of the upsampled, deformed signal consisting of 224 samples. A comparison between FIG. 14A and FIG. 14B indicates that although both signals have an amplitude of ±0.5, the number of samples corresponding to one waveform in FIG. 14B is twice the number of samples corresponding to one waveform in FIG. 14A. The signal shown in FIG. 14B is a signal obtained by doubling (n=2) the total number of samples of the signal shown in FIG. 14A by interpolating amplitude information of zero between the adjacent samples having amplitude information.

When the number of samples forming one waveform is doubled, the wavelength of the waveform is increased, resulting in a reduction in the frequency (a shift to a lower frequency range). That is, the frequency is compressed. As a result, the frequency of the upsampled signal is lower than the frequency of the yet-to-be-upsampled signal. Typically, when the number of samples of a mid-band-extracted signal is multiplied by n, the frequency of the amplitude information included in the mid-band-extracted signal is compressed to 1/n and thus the frequency components of the mid-band-extracted signal are converted into low-band frequency components. The upsampler 322 then outputs the upsampled signal (compressed signal) to the weighting unit 323.

Figure 15:
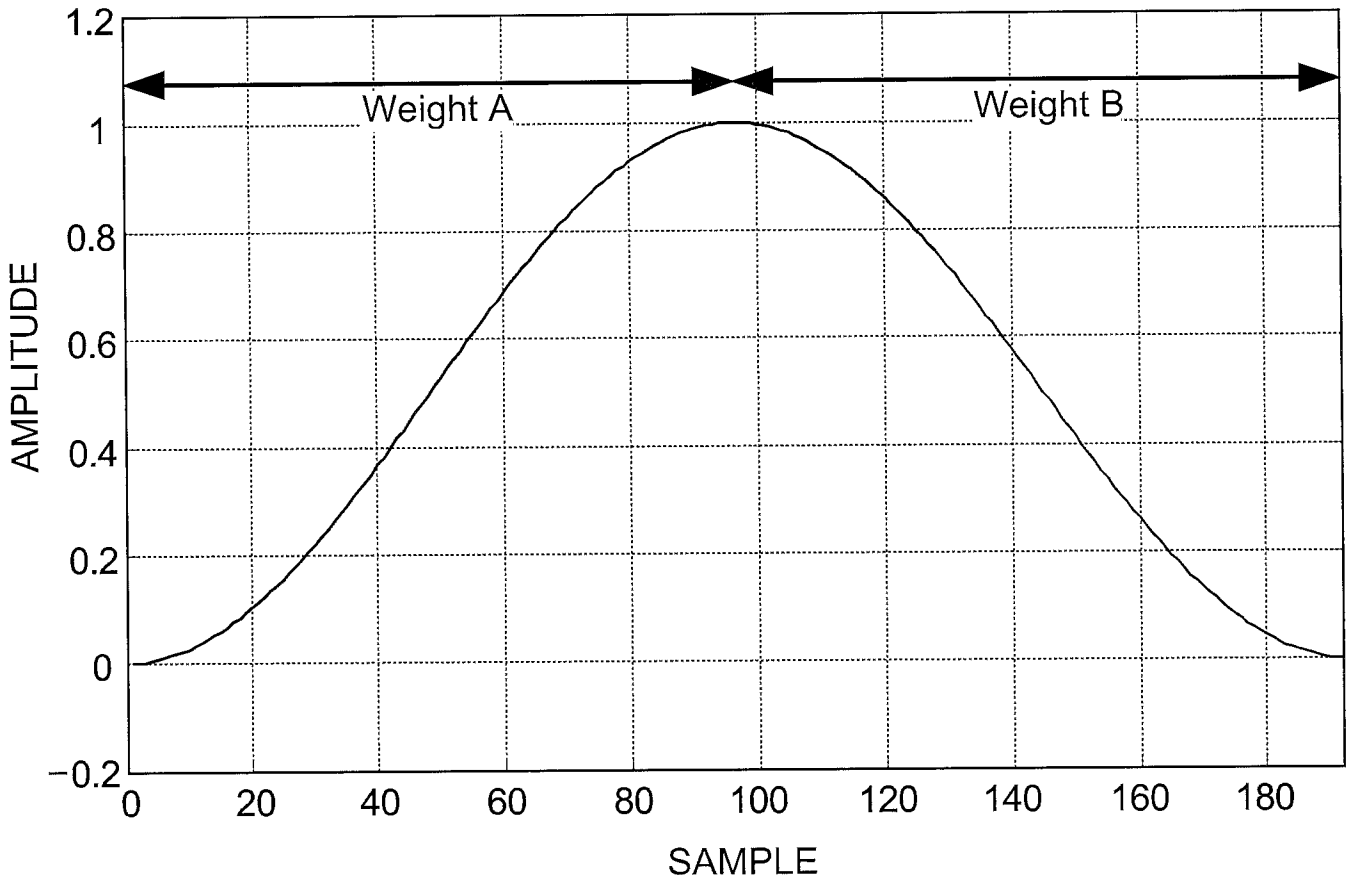
FIG. 15 is a graph showing the amount of control in an amplitude change control process performed by a weighting unit according to the present embodiment as weight characteristics and represents a Hanning window.

The weighting unit 323 controls changes in the amplitude of a predetermined number of starting samples and a predetermined number of ending samples of the upsampled signal. FIG. 15 is a graph showing the amount of change in the amplitude controlled by the weighting unit 323 as weight characteristics and represents a Hanning window (Hanning function). In the weight characteristics shown in FIG. 15, the horizontal axis represents the number of samples, and the vertical axis represents the weighting ratio of 0 to 1.0 of the amplitude. The weighting unit 323 assigns weights to the starting 96 samples and ending 96 samples of the upsampled signal. In the weight characteristics using a Hanning window shown in FIG. 15, the varying amounts of weight corresponding to 96 samples of a weight A forming the first half of the Hanning window are applied to the starting 96 samples of the upsampled signal, and the varying amounts of weight corresponding to 96 samples of a weight B forming the second half of the Hanning window are applied to the ending 96 samples of the upsampled signal.

As shown by portions corresponding to the weight A in (4) of FIG. 13, the weighting unit 323 moderates the rising of the amplitude of the starting portions of the upsampled signal by multiplying the starting 96 samples of the upsampled signal by the varying amounts of weight corresponding to the 96 samples, which correspond to the weight A in FIG. 15. Also, as shown by portions corresponding to the weight B in (4) of FIG. 13, the weighting unit 323 moderates the falling of the amplitude of the ending portions of the upsampled signal by multiplying the ending 96 samples of the upsampled signal by the varying amounts of weight corresponding to the 96 samples, which correspond to the weight B in FIG. 15. The weighting unit 323 outputs the weighted signal to the overlap adder 324.

As shown in (4) and (5) of FIG. 13, the overlap adder 324 couples (adds up) the signal portions such that the initially weighted signal portions corresponding to the weight B and the subsequently weighted signal portions corresponding to the weight A overlap each other. Thus, the overlap adder 324 is able to smooth changes in the amplitude of the overlapping portions and the preceding and following portions thereof in the coupled signal. The overlap adder 324 then outputs the overlapped signal to the band limiter 325.

The band limiter 325 limits the band of the overlapped signal. The band limiter 325 sets a low band-side cutoff frequency of 30 Hz and a high band-side cutoff frequency of 120 Hz for a quaternary Butterworth filter and limits the band using this filter. Amplitude information of zero (amplitude information for interpolation) is interpolated between the samples extracted from the mid-band-extracted signal in the sample extraction process by the sample extractor 321 and the upsampling process by the upsampler 322. For this reason, the signal may become discontinuous, and unwanted components, such as harmonics, may be generated, as shown in FIG. 14B. The band limiter 325 reduces the influence of the discontinuity of the signal by limiting the band. Note that if a larger number of samples are extracted in the sample extraction process, the influence of the discontinuity of the signal is relatively reduced, but the process delay may be increased. The band limiter 325 then outputs the band-limited signal (compressed signal) to the second envelope detector 330 and second edge emphasizer 340.

FIG. 22A shows Table 4 showing the frequency compression parameters used by the frequency compressor 320. If the reciprocal of the compression ratio is the upsampling number and the frequency is 100 to 200 Hz, the frequency compressor 320 compresses the frequency to 50 to 100 Hz, that is, the compression ratio is 1/2. Thus, the frequency compressor 320 compresses the mid-band frequency components of the mid-band-extracted signal to low-band frequency components. In other words, the frequency compressor 320 converts the signal components in the frequency band in which the user easily perceives a sound through the auditory sense into signal components in the frequency band in which the user easily perceives a vibration through the tactile sense. As a result, the user is able to perceive changes in the level of the acoustic signal as changes in the level of a vibration.

Figure 16A:
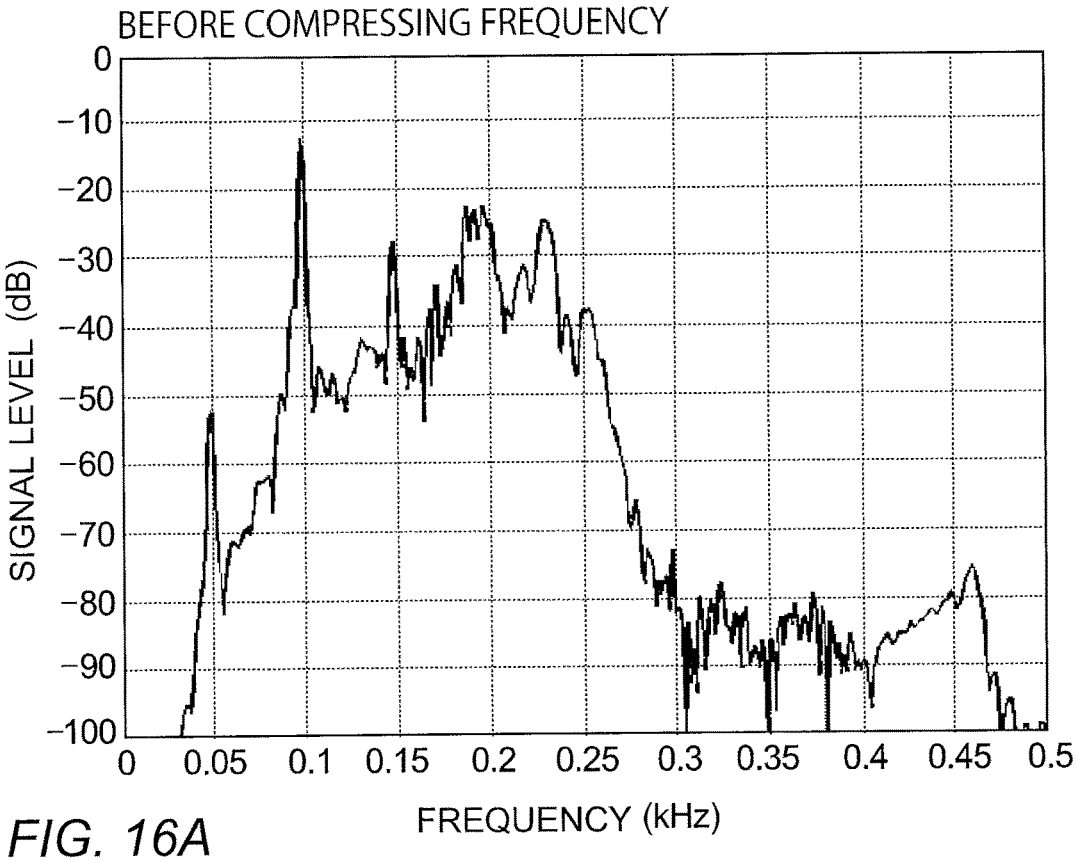
FIG. 16A is a graph showing frequency characteristics of a signal that has not been subjected to a frequency compression process by the frequency compressor according to the present embodiment.
Figure 16B:
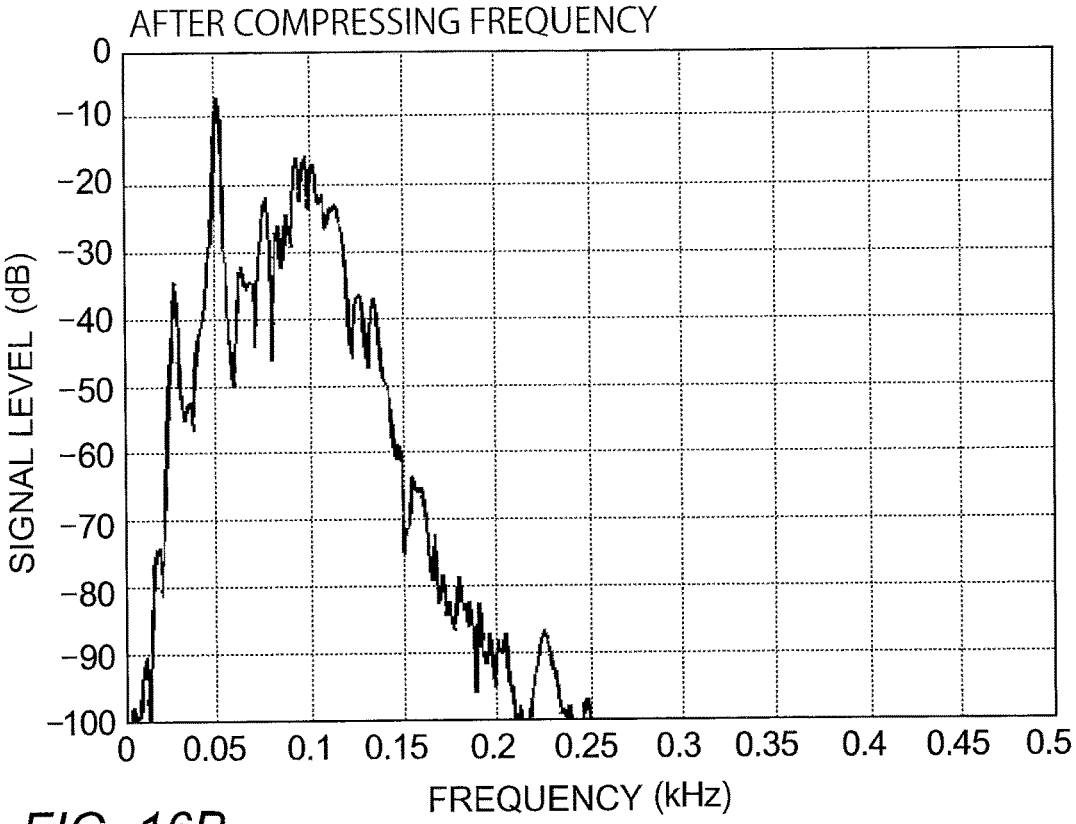
FIG. 16B is a graph showing frequency characteristics of the signal that has been subjected to the frequency compression process by the frequency compressor according to the present embodiment.

FIG. 16A shows frequency characteristics before compressing the frequency, and FIG. 16B shows frequency characteristics after compressing the frequency. As shown in FIGS. 16A and 16B, the frequency components of around 50 to 500 Hz of the received signal are compressed to frequency components of 250 Hz or less. For the frequency-compressed signal (compressed signal), only the frequency is compressed with changes in the signal level (changes in the signal level of the frequency characteristics) maintained. For this reason, the user is able to perceive changes in the signal level of a sound through the auditory sense as changes in the vibration level of a vibration through the tactile sense.

Note that the compression ratio used by the frequency compressor 320 in the frequency compression process is not limited to 1/2. The compression ratio may be changed by changing the upsampling number. For example, as shown in Table 4 of FIG. 22A, when the compression ratio is set to 1/3, the frequency of 100 to 300 Hz is compressed to 33 to 100 Hz. Also, when the compression ratio is set 1/4, the frequency of 100 to 400 Hz is compressed to 25 to 100 Hz.

[Volume Controller]

The volume controller 400 control or changes the level of the acoustic signal inputted to the vibration output apparatus 1 from the sound source playback device 10 to the signal level of a sound and the signal level of a vibration in accordance with the volume level set by the volume setting device 20. The volume controller 400 then outputs the acoustic signal having the signal level of the sound to the first amplifier 31 and outputs the signal having the signal level of the vibration (volume-controlled signal) to the weight generator 500.

Figure 17:
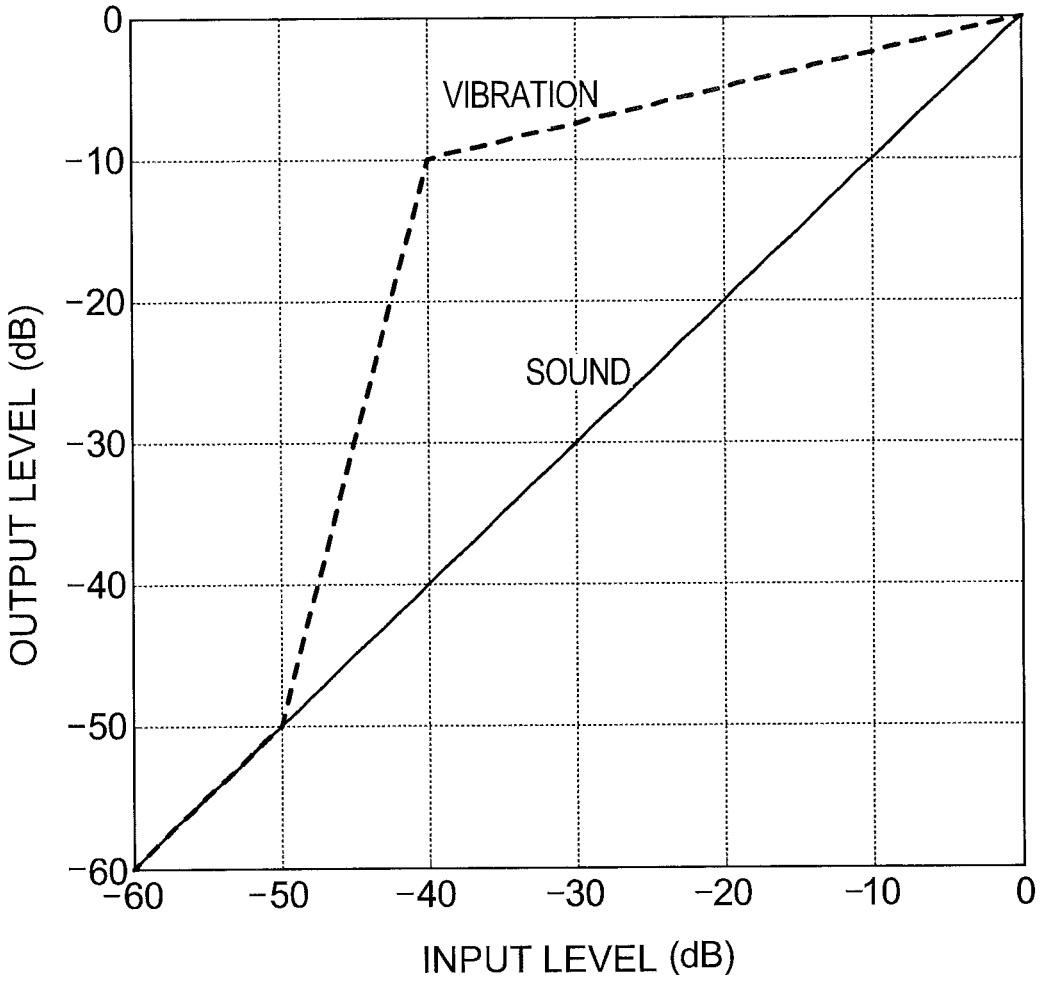
FIG. 17 shows a volume control table indicating respective cases in which a volume controller according to the present embodiment outputs the level of an acoustic signal and the level of a vibration signal on the basis of the level of a signal received from a volume setting device.

FIG. 17 shows a volume control table showing the relationships between the volume level (input level) set by the volume setting device 20 and the levels (output levels) of the volume-controlled signal to be outputted, that is, the signal output level of a sound and the output level of a vibration. As shown in FIG. 17, the signal output level of the sound is increased or reduced in proportion to the volume level (input level) set by the volume setting device 20.

When the volume level (input level) set by the volume setting device 20 is equal to or smaller than −50 dB, the output level of the vibration is increased or reduced in a range equal to or smaller than −50 dB in proportional to the set volume level. When the volume level (input level) set by the volume setting device 20 is −50 to −40 dB, the output level of the vibration is increased or reduced in a range of −50 to −10 dB in accordance with an increase or reduction in the set volume level. When the volume level (input level) set by the volume setting device 20 is −40 to −0 dB, the output level of the vibration is increased or reduced in a range of −10 to 0 dB in accordance with an increase or reduction in the set volume level.

When the volume level set by the volume setting device 20 is increased or reduced in a range of −40 to 0 dB as shown in FIG. 17, the control range of the output level of the vibration is limited to a range of −10 to 0 dB, that is, the control range of the output level of the vibration (the vibration level) becomes narrower than the control/change range of the signal level of the sound. Thus, the volume controller 400 is able to control the output level of the vibration (vibration level) considering the acoustic/vibration characteristics in which the dynamic range (signal level difference) of the tactile sense is narrower than the dynamic range (signal level difference) of the auditory sense as shown in Table 1 of FIG. 22B.

The reason why the output level of the vibration (vibration level) is controlled to the range of −10 to 0 dB is that when the volume level of the sound perceived through the auditory sense is changed in a range of −40 to 0 dB, the vibration output level (vibration level) at which the user is able to favorably perceive the signal level change as a vibration is −10 to 0 dB. When the volume level of the sound is low, for example, equal to or lower than −40 dB, the vibration output level (vibration level) is sharply reduced to less than −10 dB so that the user does not perceive the vibration much.

[Weight Generator]

The weight generator 500 generates a vibration signal to be outputted to the subwoofer SW on the basis of the low-band, level-corrected signal generated by the first level corrector 250, the low-band, maximum value-held signal (low-band maximum value signal), the compressed, level-corrected signal generated by the second level corrector 350, the maximum value-held signal for the compressed signal (compression maximum value signal), and the volume-controlled signal generated by the volume controller 400.

Figure 18:
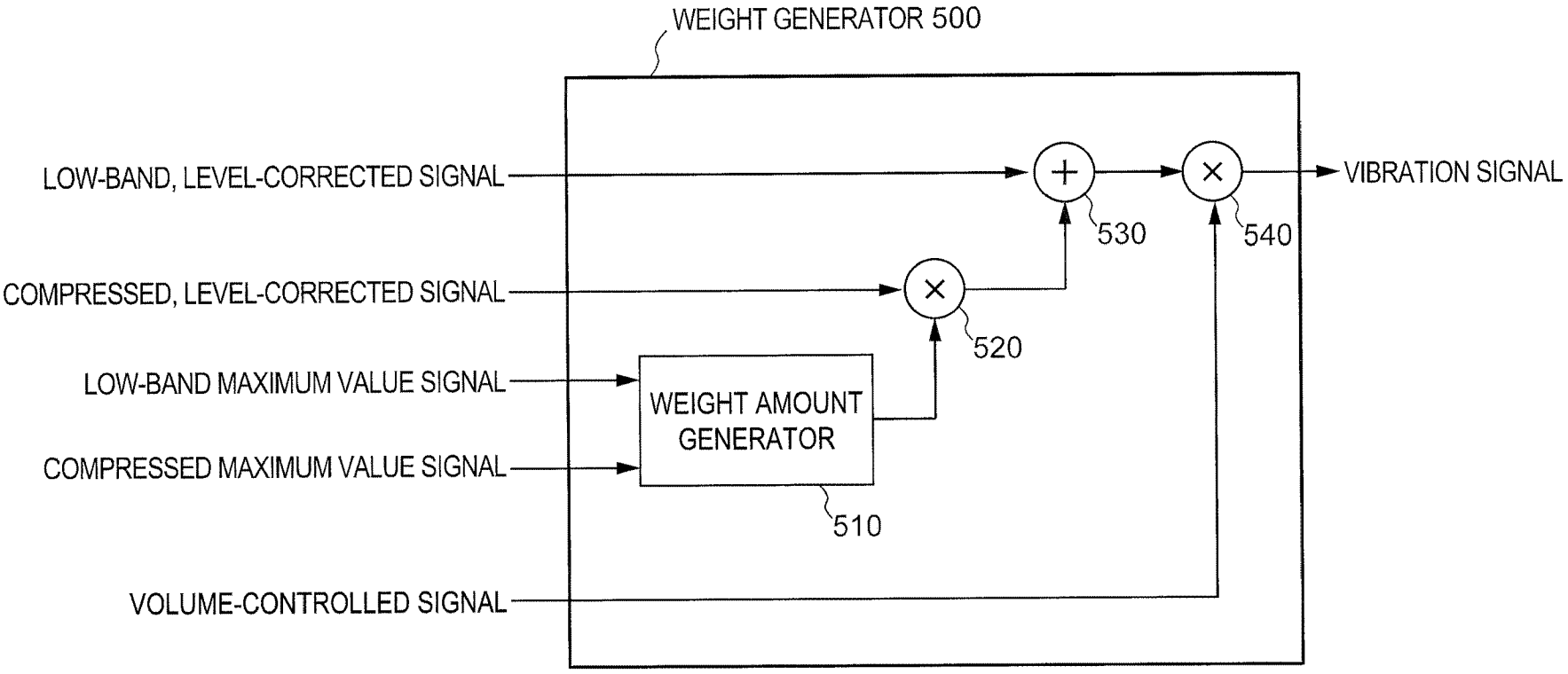
FIG. 18 is a block diagram showing a schematic configuration of a weight generator according to the present embodiment.

FIG. 18 is a block diagram showing a schematic configuration of the weight generator 500. As shown in FIG. 18, the weight generator 500 includes a weight amount generator (vibration signal generator) 510, a first multiplier 520, an adder 530, and a second multiplier 540. The weight amount generator 510 determines the amount of weight W on the basis of the following Formulas 1, 2, 3, and 4 using the low-band maximum value signal acquired from the low-band processing unit 200 and the compressed maximum value signal acquired from the mid-band processing unit 300.

When the value Lm (dB) of the low-band maximum value signal is equal to or smaller than a determination threshold α, the amount of weight W is calculated by the following Formula 1:

$$W=10^{((Mm-Lm)\cdot We)/20)} \quad \text{Formula 1}$$

where Mm represents the value (dB) of the compressed maximum value signal and We represents a weight coefficient.

When β2<W<β1 where β1 represents the upper limit of the amount of weight and β2 represents the lower limit of the amount of weight, W calculated by Formula 1 is determined as the amount of weight.

When W≥β1, β1 is determined as the amount of weight Was shown in Formula 2:

$$W=\beta 1 \quad \text{Formula 2}$$

When W≤β2, β2 is determined as the amount of weight W as shown in Formula 3:

$$W=\beta 2 \quad \text{Formula 3}$$

When Lm>α, zero (0) is determined as the amount of weight W as shown in Formula 4:

$$W=0 \quad \text{Formula 4}$$

Figure 19:
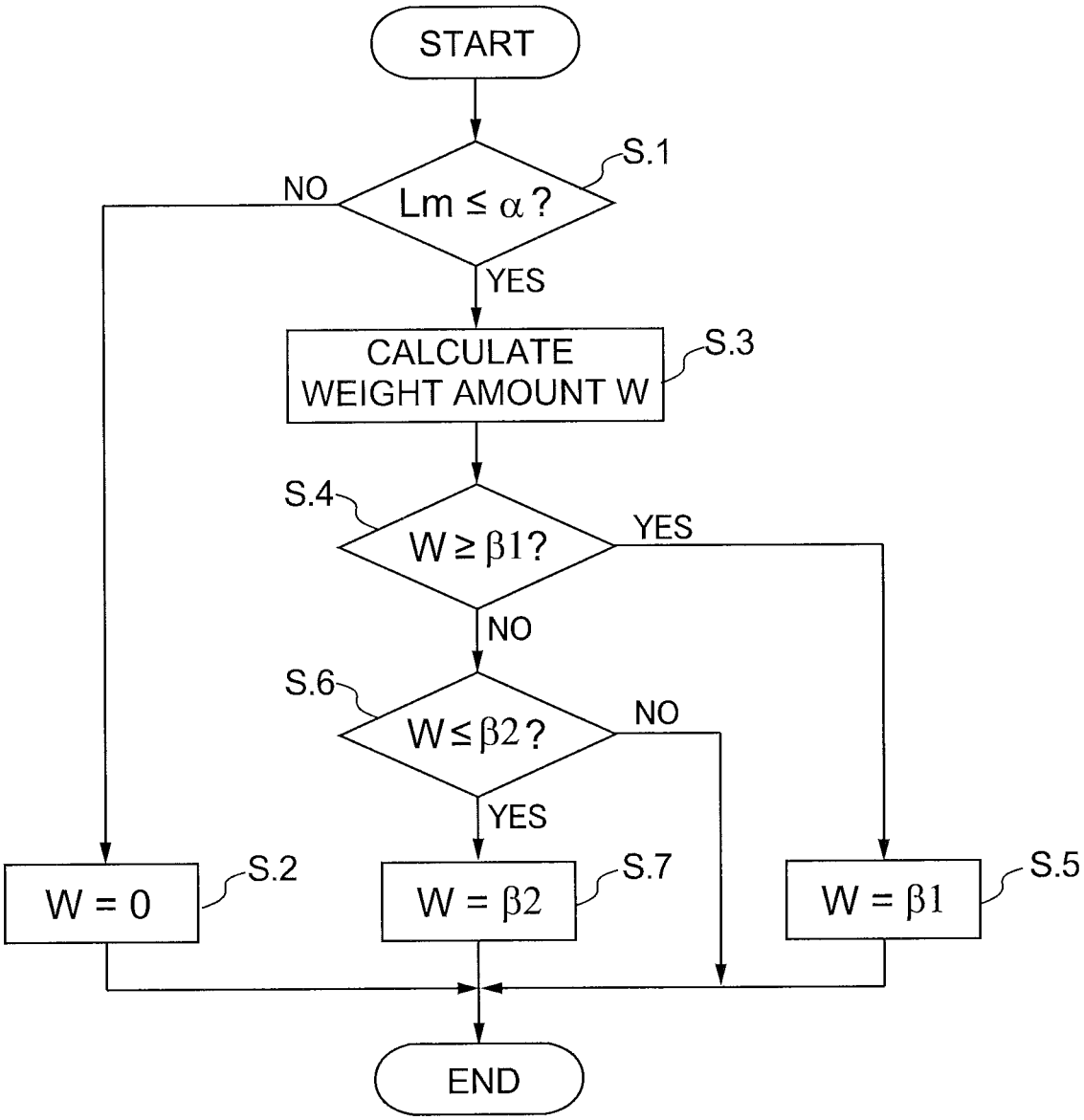
FIG. 19 is a flowchart showing a weight amount W determination process performed by the weight generator according to the present embodiment.

FIG. 19 is a flowchart showing the above-mentioned weight amount W determination process. The weight amount generator 510 determines whether the value Lm of the low-band maximum value signal is equal to or smaller than the determination threshold α (S.1). If the value Lm of the low-band maximum value signal is not equal to or smaller than the determination threshold α (NO in S.1: Lm>α), the weight amount generator 510 sets the amount of weight W to zero (0) (S.2), ending the weight amount W determination process.

If the value Lm of the low-band maximum value signal is equal to or smaller than the determination threshold α (YES in S.1), the weight amount generator 510 calculates the amount of weight W on the basis of Formula 1 (S.3). The weight amount generator 510 then determines whether the amount of weight W is equal to or greater than the upper limit β1 of the amount of weight (S.4). If the amount of weight W is equal to or greater than the upper limit β1 (YES in S.4), the weight amount generator 510 sets the amount of weight W to β1 (S.5), ending the weight amount W determination process.

If the amount of weight W is not equal to or greater than the upper limit 131 (No in S.4), the weight amount generator 510 determines whether the amount of weight W is equal to or smaller than the lower limit β2 of the amount of weight (S.6). If the amount of weight W is equal to or smaller than the lower limit β2 (Yes in S.6), the weight amount generator 510 sets the amount of weight W to β2 (S.7), ending the weight amount W determination process. If the amount of weight W is not equal to or smaller than the lower limit β2 (No in S.6), the weight amount generator 510 determines the value calculated by Formula 1 as the amount of weight W, ending the weight amount W determination process.

The weight amount generator 510 also smooths changes in the value of the continuously generated amount of weight W (weight amount signal). The weight amount generator 510 then outputs the generated amount of weight W (weight amount signal) to the first multiplier 520.

The first multiplier 520 multiplies the compressed, level-corrected signal by the amount of weight W (weight amount signal) acquired from the weight amount generator 510. The first multiplier 520 then outputs the multiplied signal to the adder 530. The adder 530 combines (adds up) the multiplied signal acquired from the first multiplier 520 and the low-band, level-corrected signal. The adder 530 then outputs the added-up signal to the second multiplier 540. The second multiplier 540 generates a vibration signal by multiplying the signal acquired from the adder 530 (the signal added up by the adder 530) by the volume-controlled signal acquired from the volume controller 400 and thus controlling the vibration level. The second multiplier 540 then outputs the generated vibration signal to the upsampler 600.

For example, the weight generator 500 according to the present embodiment generates a vibration signal by setting the weight coefficient Wc to 0.7, setting the determination threshold α to −24 dB, setting the weight amount upper limit β1 to 16 dB, and setting the weight amount lower limit β2 to 0 dB.

Figure 20A:
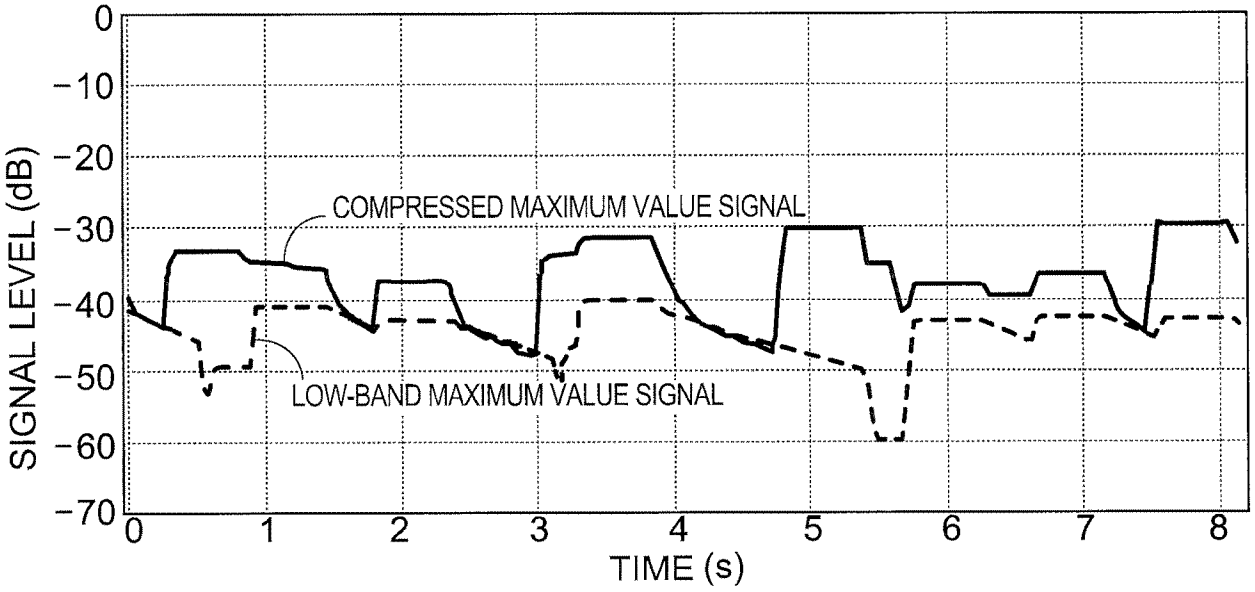
FIG. 20A is a graph showing a compressed maximum value signal and a low-band maximum value signal according to the present embodiment.
Figure 20B:
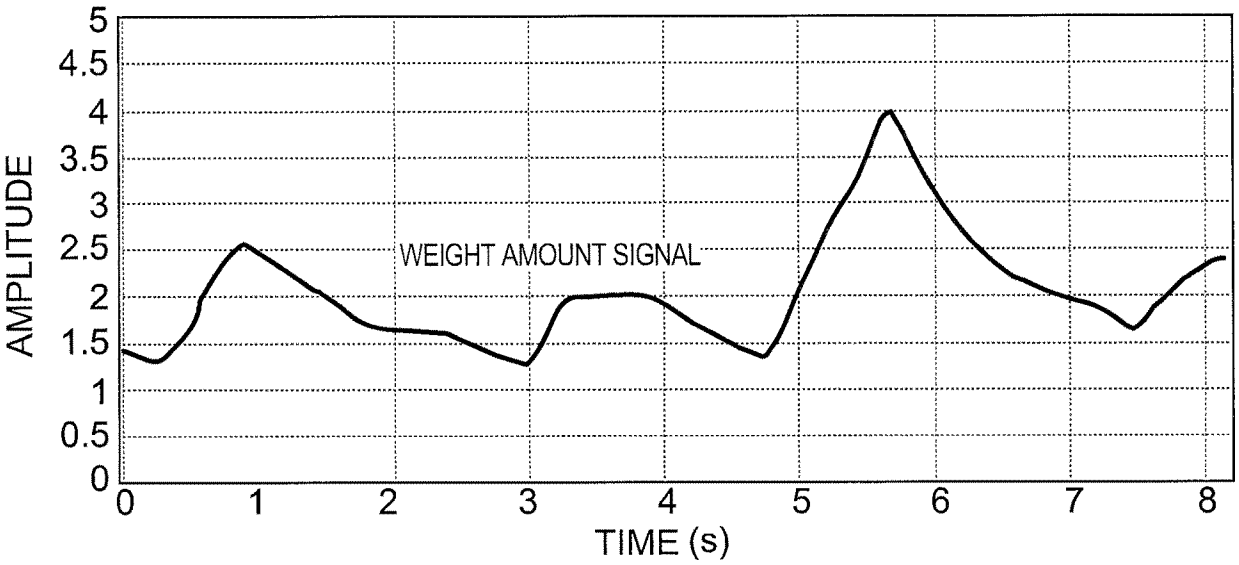
FIG. 20B is a graph showing a weight amount signal according to the present embodiment.

FIG. 20A is a graph showing temporal changes in the compressed maximum value signal and the low-band maximum value signal, and FIG. 20B is a graph showing temporal changes of the amount of weight W (weight amount signal) calculated by the weight amount generator 510. The compressed maximum value signal and low-band maximum value signal are signals obtained by holding the maximum value for a predetermined time and therefore are shown in FIG. 20A such that the maximum value is held for the predetermined time. Since Formula 1 is also used as a formula that converts a decibel signal into a linear signal, the vertical axis of FIG. 20A represents the signal level (dB), while the vertical axis of FIG. 20B represents the amplitude.

As shown in Formula 1, the amount of weight W is calculated using the value obtained by subtracting the value Lm of the low-band maximum value signal from the value Mm of the compressed maximum value signal. For this reason, if there is a large difference between the value Lm of the low-band maximum value signal and the value Mm of the compressed maximum value signal, the value of the amount of weight W of the weight amount signal is increased, as shown in FIG. 20B. In this case, it can be determined that the acoustic signal does not include a large amount of low-band frequency components. For this reason, if the amount of weight W is increased, the amount of the mid-band frequency components that have been frequency-compressed to a low band is increased in the vibration signal.

On the other hand, if it can be determined that the acoustic signal includes low-band frequency components having a sufficient signal level, there is no need to increase the amount of weight W. The value of the determination threshold α is used as a criterion for determining whether the acoustic signal includes low-band frequency components having a sufficient signal level. The weight amount generator 510 according to the present embodiment sets the determination threshold α to −24 dB. Thus, if the value Lm of the low-band maximum value signal is greater than −24 dB, the weight amount generator 510 determines that the acoustic signal includes low-band frequency components having a sufficient signal level.

The value Lm of the low-band maximum value signal is the value of the signal obtained by holding the maximum value of the low-band, envelope-detected signal and represents the value of the signal level in the low frequency range set by the low-band extractor 210 considering the dynamic range of the vibration. Accordingly, if the value Lm of the low-band maximum value signal is greater than the determination threshold α and it is determined that the acoustic signal includes low-band frequency components having a sufficient signal level, zero (0) is determined as the amount of weight W (see Formula 4). Thus, the compressed, level-corrected signal is multiplied by the value of zero (0), and the compressed, level-corrected signal inputted to the adder 530 is substantially lost. As a result, a vibration signal is generated from only the low-band, level-corrected signal.

Even if the vibration signal is generated from the low-band, level-corrected signal without using the compressed, level-corrected signal, the subwoofer SW is able to output a magnitude of vibration that the user is able to perceive, since the acoustic signal includes the low-band frequency components having a sufficient signal level. The low-band, level-corrected signal is the level-corrected signal generated by the level converter 254 of the first level corrector 250. For this reason, even if the vibration signal is generated from the low-band, level-corrected signal without using the compressed, level-corrected signal, the weight generator 500 is able to ensure a sufficient vibration level.

If the value Lm of the low-band maximum value signal is equal to or smaller than the determination threshold α and the acoustic signal does not include low-band frequency components having a sufficient signal level, the weight generator 500 determines the amount of weight W on the basis of Formulas 1 to 3. By combining (adding up) the compressed, level-corrected signal multiplied by the determined amount of weight W and the low-band, level-corrected signal using the adder 530, the weight generator 500 is able to generate a vibration having a sufficient magnitude including not only the signal level of the low-band frequency components but also the signal level of the mid-band frequency components. Thus, the subwoofer SW is able to output a magnitude of vibration that the user is able to perceive.

The determination threshold α is used as a criterion for determining whether the acoustic signal includes low-band frequency components having a sufficient signal level. Accordingly, the determination threshold α represents the minimum signal level that allows the weight generator 500 to generate a vibration signal having a sufficient magnitude including only the signal level of low-band frequency components without having to add the signal level of mid-band frequency components.

A specific example of a method for determining the determination threshold α involves previously empirically setting the values of multiple determination thresholds a and determining which determination threshold allows the user seated on the seat to perceive a sufficient magnitude of vibration from the subwoofer SW. Such a method is able to determine a determination threshold α most suitable for the environment in which the vibration output apparatus 1 is installed.

If the determination threshold α is set to a value greater than the most suitable value (signal level) (for example, the determination threshold α is set to −12 dB), mid-band frequency components may be added up in the acoustic signal, although the acoustic signal includes a sufficient level of low-band frequency components. Consequently, a vibration signal having an excessively high level (vibration level) may be generated.

On the other hand, if the determination threshold α is set to a value smaller than the most suitable value (signal level) (for example, the determination threshold α is set to −48 dB), mid-band frequency components may not be added up in the acoustic signal, although the acoustic signal does not include low-band frequency components having a sufficient level. Also, the level converter 254 of the first level corrector 250 may not sufficiently correct the level when performing level conversion. In this case, a vibration signal having a low level (vibration level) may be generated and thus the user may not be able to perceive the vibration.

For these reasons, it is important to set the determination threshold α to a value that allows the user to reliably and sufficiently perceive the vibration and that is most suitable for the operating environment of the vibration output apparatus 1.

The weight generator 500 outputs the generated vibration signal to the upsampler 600. As described above, the upsampler 600 upsamples the vibration signal acquired from the weight generator 500 and outputs the upsampled vibration signal to the second amplifier 32. As described above, the second amplifier 32 amplifies the signal acquired from the upsampler 600 and outputs the amplified vibration signal to the sub-woofer SW, which then outputs (generates) a vibration.

As described above, the frequency range or dynamic range (signal level difference) of a vibration signal that the user is able to perceive as a vibration through the tactile sense tends to be narrower than the frequency range or dynamic range (signal level difference) of an acoustic signal that the user is able to perceive as a sound through the auditory sense.

The volume controller 400 of the vibration output apparatus 1 performs level control by narrowing the variation width (−10 to 0 dB) of the vibration level of the vibration signal outputted to the subwoofer SW through the second amplifier 32 compared to the variation width (−40 to 0 dB) of the level of the acoustic signal outputted to the full-range speakers SP1 and SP2 through the first amplifier 31, considering the difference in dynamic range (signal level difference) between the vibration and sound. Thus, the vibration output apparatus 1 allows the user to perceive a vibration in a dynamic range corresponding to the signal level difference of a sound perceived by the user, as well as is able to enhance the togetherness of the sound and vibration and to output the sound and vibration without causing a feeling of strangeness.

The frequency compressor 320 of the vibration output apparatus 1 converts the frequency components of 100 Hz or more, which the user is able to perceive as a sound but has difficulty in perceiving as a vibration, of the frequency components of the acoustic signal inputted to the vibration output apparatus 1 into a signal of 100 Hz or less, which the user easily perceives as a vibration by compressing (shifting) the frequency considering the difference between the frequency range of an acoustic signal that the user is able to perceive as a sound through the auditory sense and the frequency range of a vibration signal that the user is able to perceive as a vibration through the tactile sense. Thus, the frequency compressor 320 converts changes in the signal level in the frequency range of a sound that the user is able to perceive through the auditory sense into changes in the vibration level in the frequency range of a vibration that the user is able to perceive through the tactile sense. As a result, the user is able to perceive a vibration through the tactile sense with effective realism similar to the realism of a sound that the user is able to perceive through the auditory sense.

When combining the compressed, level-corrected signal with the low-band, level-corrected signal, the weight generator 500 of the vibration output apparatus 1 determines the amount of weight by which the compressed, level-corrected signal is multiplied and controls the level of the compressed, level-corrected signal to be added to the low-band, level-corrected signal in accordance with the signal level of the low-band frequency components of the frequency components of the acoustic signal, or the like.

Specifically, the amount of weight W is calculated and determined on the basis of Formulas 1 to 4. For example, if there is a large difference between the value Mm of the compressed maximum value signal and the value Lm of the low-band maximum value signal (Mm−Lm is large) as shown in Formula 1, it can be determined that the signal level of the low-band frequency components that the user is able to perceive as a vibration is lower than the signal level of the mid-band frequency components that the user is less likely to perceive as a vibration. In this case, the perceptibility of a vibration through the tactile sense of the user may be lower than the perceptibility of a sound based on the acoustic signal through the auditory sense of the user. For this reason, the frequency compressor 320 compresses the mid-band frequency components to low-band frequency components and thus shifts the signal level of the mid-band frequency components to the signal level of the low-band frequency components. Thus, the weight generator 500 is able to control changes in the signal level in the wider frequency range so that the user is able to perceive the signal-level changes as a vibration.

If there is a small difference between the value Mm of the compressed maximum value signal and the value Lm of the low-band maximum value signal (Mm−Lm is small), it can be determined that the acoustic signal includes low-band frequency components having a sufficient level. In this case, the weight generator 500 sets the amount of weight W to a lower value and thus is able to prevent the signal level of the mid-band frequency components from being excessively included in the low-band frequency components. Thus, the weight generator 500 is able to prevent the perceptibility and realism of the vibration from becoming excessively greater than those of the sound and thus to realize the togetherness of the sound and vibration.

If the value Lm of the low-band maximum value signal is greater than the predetermined threshold $\alpha$ ($Lm \geq \alpha$), the weight generator 500 sets the amount of weight W to 0 (zero). Thus, the weight generator 500 is able to prevent the frequency-compressed mid-band frequency components from being added to the low-band frequency components and thus to prevent the signal level of the low-band frequency components from being excessively increased.

If the value Lm of the low-band maximum value signal is equal to or smaller than the predetermined threshold $\alpha$ ($Lm \leq \alpha$), the weight generator 500 previously sets the upper limit $\beta 1$ and lower limit $\beta 2$ of the amount of weight and controls the amount of weight W so that the amount of weight W falls within a range between the upper limit $\beta 1$ and lower limit $\beta 2$. Thus, the weight generator 500 is able to add a proper amount of signal components of the frequency-compressed signal to the low-band frequency components and thus to properly control the vibration level without impairing the togetherness of the sound and vibration.

The edge emphasizers 240 and 340 of the vibration output apparatus 1 are able to accentuate the vibration signal by performing a rising emphasis process of emphasizing the rising of the vibration level when a vibration is outputted and a falling emphasis process of quickly performing falling of the vibration level when the vibration is reduced. Thus, the subwoofer SW is able to output an accentuated vibration.

The perceptibility of a vibration that the user perceives through the tactile sense (the level change perceptibility) tends to be lower than the perceptibility of a sound that the user perceives through the auditory sense (the level change perceptibility). The edge emphasizers 240 and 340 are able to improve the perceptibility of a vibration that the user perceives through the tactile sense, by emphasizing the rising and falling of the vibration level and thus to compensate for the difference with the perceptibility of a sound that the user perceives through the auditory sense and further improve the togetherness of the sound and vibration.

The attack/release time controllers of the first level corrector 250 and second level corrector 350 perform attack time control and release time control on the signals subjected to the vibration level rising/falling emphasis process by the edge emphasizers 240 and 340. However, if the level of the maximum value-held signal is equal to or smaller than −40 dB (control minimum value), the attack/release time controllers stop the attack time control and release time control. Thus, the attack/release time controllers are able to control the extent to which the first level corrector 250 and second level corrector 350 correct the acoustic signals whose amplitude greatly varies (low band-extracted signal, compressed signal) and thus to prevent the correction made by the first level corrector 250 and second level corrector 350 from becoming overcontrol.

The vibration output apparatus and computer-readable, non-transitory storage medium storing a vibration output program according to the embodiment of the present invention have been described in detail using the vibration output apparatus 1. However, the vibration output apparatus and computer-readable, non-transitory storage medium storing a vibration output program according to the embodiment of the present invention is not limited to the configuration or the like of the vibration output apparatus 1 and may be configured otherwise.

For example, the set values specifically described in the above embodiment, for example, the numerical values shown in Tables 2 to 4 are only illustrative and are not limiting. The settings described in Formulas 1 to 4 are also only illustrative and are not limiting.

While, in the above embodiment, both the edge emphasizers 240 and 340 of the vibration output apparatus 1 perform the vibration level rising/falling emphasis processes, the vibration output apparatus and computer-readable, non-transitory storage medium storing a vibration output program according to the embodiment of the present invention need not necessarily include both the edge emphasizers 240 and 340 and one or both of the edge emphasizers may be omitted as necessary.

The edge emphasizers 240 and 340 need not necessarily perform both rising/falling emphasis processes and may perform one of the rising/falling emphasis processes. Performing at least one of the rising/falling emphasis processes allows for accentuating a vibration signal and thus outputting an accentuated vibration from the subwoofer SW.

What is claimed is:

1. A vibration output apparatus comprising:

a low-band signal generator configured to generate a low-band signal by extracting low-band frequency components from an acoustic signal;

a mid-band signal generator configured to generate a mid-band signal by extracting mid-band frequency components from the acoustic signal, the mid-band signal including samples arranged in a time-series manner and each having amplitude information;

a frequency compressor configured to generate a compressed signal by converting frequency components of the mid-band signal into the low-band frequency components of the low-band signal by increasing the total number of samples by a factor of n and thus compressing a frequency of the amplitude information included in the mid-band frequency components of the mid-band signal to 1/n by interpolating amplitude information for interpolation between the adjacent samples having the amplitude information;

a low-band envelope signal calculator configured to calculate a low-band envelope signal by performing an integration process on the low-band signal;

a vibration signal generator configured to, when a level of the low-band envelope signal is lower than a predetermined threshold level, generate a vibration signal by combining the compressed signal with the low-band signal and to, when the level of the low-band envelope signal is higher than the predetermined threshold level, generate the vibration signal by directly using the low-band signal; and a vibration output unit configured to output a vibration on the basis of the vibration signal generated by the vibration signal generator.

2. The vibration output apparatus according to claim 1, further comprising:

a compressed envelope signal calculator configured to calculate a compressed envelope signal by performing an integration process on the compressed signal; and a weight amount determination unit configured to determine an amount of weight in accordance with a value obtained by subtracting a level of the low-band envelope signal from a level of the compressed envelope signal, wherein if the level of the low-band envelope signal is lower than the predetermined threshold level, the vibration signal generator generates the vibration signal by multiplying the compressed signal by the amount of weight determined by the weight amount determination unit and combining the multiplied signal with the low-band signal.

3. The vibration output apparatus according to claim 1, further comprising a low-band edge processing unit configured to perform an edge processing on the low-band signal by differentiating the low-band envelope signal to detect at least one of a rising timing at which an amplitude value of the low-band signal sharply increases and a falling timing at which the amplitude value of the low-band signal sharply decreases, increasing the amplitude value of the low-band signal at the rising timing if the rising timing is detected, and suppressing the amplitude value of the low-band signal at the falling timing if the falling timing is detected, wherein the vibration signal generator generates the vibration signal on the basis of the low-band signal subjected to the edge processing by the low-band edge processing unit.

4. The vibration output apparatus according to claim 2, further comprising a compression edge processing unit configured to perform an edge processing on the compressed signal by differentiating the compressed envelope signal to detect at least one of a rising timing at which an amplitude value of the compressed signal sharply increases and a falling timing at which the amplitude value of the compressed signal sharply decreases, increasing the amplitude value of the compressed signal at the rising timing if the rising timing is detected, and suppressing the amplitude value of the compressed signal at the falling timing if the falling timing is detected, wherein the vibration signal generator generates the vibration signal on the basis of the compressed signal subjected to the edge processing by the compression edge processing unit.

5. The vibration output apparatus according to claim 3, further comprising a compression edge processing unit configured to perform an edge processing on the compressed signal by differentiating the compressed envelope signal to detect at least one of a rising timing at which an amplitude value of the compressed signal sharply increases and a falling timing at which the amplitude value of the compressed signal sharply decreases, increasing the amplitude value of the compressed signal at the rising timing if the rising timing is detected, and suppressing the amplitude value of the compressed signal at the falling timing if the falling timing is detected, wherein the vibration signal generator generates the vibration signal on the basis of the compressed signal subjected to the edge processing by the compression edge processing unit.

6. The vibration output apparatus according to claim 1, further comprising a vibration level determination unit configured to acquire a volume level controlled by a user, of the acoustic signal and to determine a vibration level of the vibration signal corresponding to the volume level from a control range of the vibration level of the vibration signal narrower than a control range of the volume level of the acoustic signal, wherein the vibration signal generator controls the vibration level of the vibration signal by multiplying the vibration signal by the vibration level determined by the vibration level determination unit.

7. A computer-readable, non-transitory storage medium storing a vibration output program executed by a vibration output apparatus configured to output a vibration from a vibration output unit on the basis of a vibration signal, the vibration output program causing a controller to perform:

a low-band signal generation process of generating a low-band signal by extracting low-band frequency components from an acoustic signal;

a mid-band signal generation process of generating a mid-band signal by extracting mid-band frequency components from the acoustic signal, the mid-band signal including samples arranged in a time-series manner and each having amplitude information;

a frequency compression process of generating a compressed signal by converting frequency components of the mid-band signal into the low-band frequency components of the low-band signal by increasing the total number of samples by a factor of n and thus compressing a frequency of the amplitude information included in the mid-band frequency components of the mid-band signal to 1/n by interpolating amplitude information for interpolation between the adjacent samples having the amplitude information;

a low-band envelope signal calculation process of calculating a low-band envelope signal by performing an integration process on the low-band signal;

a vibration signal generation process of, when a level of the low-band envelope signal is lower than a predetermined threshold level, generating the vibration signal by combining the compressed signal with the low-band signal and, when the level of the low-band envelope signal is higher than the predetermined threshold level, generating the vibration signal by directly using the low-band signal; and a vibration output process of outputting the vibration from the vibration output unit on the basis of the vibration signal generated in the vibration signal generation process.

8. The computer-readable, non-transitory storage medium storing a vibration output program according to claim 7, the vibration output program causing the controller to further perform:

a compressed envelope signal calculation process of calculating a compressed envelope signal by performing an integration process on the compressed signal; and a weight amount determination process of determining an amount of weight in accordance with a value obtained by subtracting a level of the low-band envelope signal from a level of the compressed envelope signal, wherein the vibration signal generation process comprises, if the level of the low-band envelope signal is lower than the predetermined threshold level, generating the vibration signal by multiplying the compressed signal by the amount of weight determined in the weight amount determination process and combining the multiplied signal with the low-band signal.

9. The computer-readable, non-transitory storage medium storing a vibration output program according to claim 7, the vibration output program causing the controller to further perform a low-band edge processing process of performing an edge processing on the low-band signal by differentiating the low-band envelope signal to detect at least one of a rising timing at which an amplitude value of the low-band signal sharply increases and a falling timing at which the amplitude value of the low-band signal sharply decreases, increasing the amplitude value of the low-band signal at the rising timing if the rising timing is detected, and suppressing the amplitude value of the low-band signal at the falling timing if the falling timing is detected, wherein the vibration signal generation process comprises generating the vibration signal on the basis of the low-band signal subjected to the edge processing in the low-band edge processing process.

10. The computer-readable, non-transitory storage medium storing a vibration output program according to claim 8, the vibration output program causing the controller to further perform a compression edge processing process of performing an edge processing on the compressed signal by differentiating the compressed envelope signal to detect at least one of a rising timing at which an amplitude value of the compressed signal sharply increases and a falling timing at which the amplitude value of the compressed signal sharply decreases, increasing the amplitude value of the compressed signal at the rising timing if the rising timing is detected, and suppressing the amplitude value of the compressed signal at the falling timing if the falling timing is detected, wherein the vibration signal generation process comprises generating the vibration signal on the basis of the compressed signal subjected to the edge processing in the compression edge processing process.

11. The computer-readable, non-transitory storage medium storing a vibration output program according to claim 9, the vibration output program causing the controller to further perform a compression edge processing process of performing an edge processing on the compressed signal by differentiating the compressed envelope signal to detect at least one of a rising timing at which an amplitude value of the compressed signal sharply increases and a falling timing at which the amplitude value of the compressed signal sharply decreases, increasing the amplitude value of the compressed signal at the rising timing if the rising timing is detected, and suppressing the amplitude value of the compressed signal at the falling timing if the falling timing is detected, wherein the vibration signal generation process comprises generating the vibration signal on the basis of the compressed signal subjected to the edge processing in the compression edge processing process.

12. The computer-readable, non-transitory storage medium storing a vibration output program according to claim 7, the vibration output program causing the controller to further perform a vibration level determination process of acquiring a volume level controlled by a user, of the acoustic signal and determining a vibration level of the vibration signal corresponding to the volume level from a control range of the vibration level of the vibration signal narrower than a control range of the volume level of the acoustic signal, wherein the vibration signal generation process comprises controlling the vibration level of the vibration signal by multiplying the vibration signal by the vibration level determined in the vibration level determination process.

* * * * *